US008305303B2

(12) United States Patent
Nam

(10) Patent No.: US 8,305,303 B2
(45) Date of Patent: Nov. 6, 2012

(54) ORGANIC LIGHT EMITTING DIODE DISPLAY AND METHOD OF DRIVING THE SAME

(75) Inventor: Woo Jin Nam, Seongnam-si (KR)

(73) Assignee: LG Display Co., Ltd., Seoul (KR)

( * ) Notice: Subject to any disclaimer, the term of this patent is extended or adjusted under 35 U.S.C. 154(b) by 878 days.

(21) Appl. No.: 12/289,190

(22) Filed: Oct. 22, 2008

(65) Prior Publication Data

US 2009/0213046 A1 Aug. 27, 2009

(30) Foreign Application Priority Data

Feb. 22, 2008 (KR) ..... 10-2008-0016503

(51) Int. Cl.
*G09G 3/30* (2006.01)

(52) U.S. Cl. ..... 345/76; 345/30; 345/55; 345/77; 315/169.3

(58) Field of Classification Search ..... None
See application file for complete search history.

(56) References Cited

U.S. PATENT DOCUMENTS

| | | | | |
|---|---|---|---|---|
| 5,751,279 | A * | 5/1998 | Okumura | 345/212 |
| 6,229,506 | B1 * | 5/2001 | Dawson et al. | 345/82 |
| 2004/0130545 | A1 * | 7/2004 | Ishizuka | 345/212 |
| 2005/0212445 | A1 * | 9/2005 | Lee | 315/169.3 |
| 2008/0180365 | A1 | 7/2008 | Ozaki | |

FOREIGN PATENT DOCUMENTS

| | | | |
|---|---|---|---|
| CN | 1674740 | A | 9/2005 |
| WO | 2006/053424 | A1 | 5/2006 |
| WO | WO 2007/037269 | A1 | 4/2007 |
| WO | WO 2008/018629 | A1 | 2/2008 |

OTHER PUBLICATIONS

European Search Report dated Aug. 17, 2011.
Chinese Office Action (Application No. 200810175222.1), dated Apr. 27, 2012.

* cited by examiner

*Primary Examiner* — Amare Mengistu
*Assistant Examiner* — Jesus Hernandez
(74) *Attorney, Agent, or Firm* — Morgan, Lewis & Bockius LLP

(57) ABSTRACT

An organic light emitting diode display includes a data line, a gate line that crosses the data line to receive a scan pulse, a high potential driving voltage source to generate a high potential driving voltage, a low potential driving voltage source to generate a low potential driving voltage, a light emitting element to emit light due to a current flowing between the high potential driving voltage source and the low potential driving voltage source, a drive element connected between the high potential driving voltage source and the light emitting element to control a current flowing in the light emitting element depending on a voltage between a gate electrode and a source electrode of the drive element, and a driving current stabilization circuit to apply a first voltage to the gate electrode of the drive element to turn on the drive element and to sink a reference current through the drive element to set a source voltage of the drive element at a sensing voltage and to modify the voltage between the gate and source electrodes of the drive element to scale a current to be applied to the light emitting element from the reference current.

18 Claims, 16 Drawing Sheets

ORGANIC LIGHT EMITTING DIODE DISPLAY AND METHOD OF DRIVING THE SAME

This application claims the benefit of Korea Patent Application No. 10-2008-0016503 filed on Feb. 22, 2008, which is incorporated herein by reference for all purposes as if fully set forth herein.

BACKGROUND OF THE INVENTION

1. Field of the Invention

The present invention relates to an organic light emitting diode display, and more particularly to an organic light emitting diode display and a method of driving the same capable of increasing the display quality by preventing a driving current from becoming degraded by the degradation of a drive thin film transistor (TFT) depending on driving time.

2. Discussion of the Related Art

Recently, various kinds of flat panel display devices with reduced weight and size have been developed as a replacement of cathode ray tubes. Examples of the flat panel display devices include liquid crystal displays (LCD), field emission displays (FED), plasma display panels (PDP), and electroluminescence devices. Because the structure and manufacturing process of plasma display panels are simple, the plasma display panels have been considered for large-sized display devices that are relatively light and thin. However, the emitting efficiency and luminance of the plasma display panel are low while its power consumption is high. As an alternative, thin film transistor (TFT) LCD using TFTs as a switching device is widely used. However, the TFT-LCD is a non-emitting device. Therefore, the TFT-LCD has a narrow viewing angle and a low response speed. The electroluminescence device, on the other hand, is a self-emitting device. The electroluminescence device may be classified into an inorganic light emitting diode display category and an organic light emitting diode (OLED) display category depending on the material of an emitting layer. Because the OLED display includes a self-emitting device, the OLED display has high response speed, high emitting efficiency, strong luminance, and wide viewing angle.

An OLED display includes an organic light emitting diode. As shown in FIG. 1, the organic light emitting diode includes organic compound layers 78*a*, 78*b*, 78*c*, 78*d*, and 78*e* between an anode electrode and a cathode electrode. The organic compound layers include an electron injection layer 78*a*, an electron transport layer 78*b*, an emitting layer 78*c*, a hole transport layer 78*d*, and a hole injection layer 78*e*. When a driving voltage is applied to the anode electrode and the cathode electrode, holes passing through the hole transport layer 78*d* and electrons passing through the electron transport layer 78*b* move to the emitting layer 78*c* to form an exciton. Hence, the emitting layer 78*c* generates visible light.

The OLED display is arranged with pixels including the organic light emitting diode in a matrix format and controls brightness of the pixels selected by a scan pulse depending on a gray level of digital video data. The OLED display may be classified into a passive matrix type OLED display and an active matrix type OLED display using a thin film transistor as a switching device. In particular, the active matrix type OLED display selectively turns on the thin film transistor used as the switching device to select the pixel and maintains an emission of the pixel using a voltage hold by a storage capacitor.

FIG. 2 is an equivalent circuit diagram showing one pixel in a related art active matrix type OLED display. As shown in FIG. 2, an pixel of the related art active matrix type OLED display includes an organic light emitting diode OLED, data lines DL and gate lines GL that cross each other, a switching thin film transistor SW, a drive thin film transistor DR, and a storage capacitor Cst. The switch TFT SW and the drive TFT DR may be an N-type metal-oxide semiconductor field effect transistor (MOSFET).

The switching TFT SW is turned on in response to a scan pulse received through the gate line GL, and thus a current path between a source electrode and a drain electrode of the switching TFT SW is turned on. During on-time of the switching TFT SW, a data voltage received from the data line DL is applied to a gate electrode of the drive TFT DR and the storage capacitor Cst via the source electrode and the drain electrode of the switching TFT SW. The drive TFT DR controls a current flowing in the organic light emitting diode OLED depending on a voltage difference Vgs between the gate electrode and a source electrode of the drive TFT DR. The storage capacitor Cst stores the data voltage applied to an electrode at one end of the storage capacitor Cst to keep a voltage applied to the gate electrode of the drive TFT DR constant during a frame period.

The organic light emitting diode OLED may have a structure shown in FIG. 1. The organic light emitting diode OLED is connected between the source electrode of the drive TFT DR and a low potential driving voltage source VSS. A brightness of the pixel shown in FIG. 2 is proportional to the current flowing in the organic light emitting diode OLED as indicated in the following Equation 1:

$$Vgs = Vg - Vs$$

$$Vg = Vdata, \quad Vs = Vss$$

$$Ioled = \frac{\beta}{2}(Vgs - Vth)^2 = \frac{\beta}{2}(Vdata - Vss - Vth)^2$$

In the above Equation 1, Vgs indicates a voltage difference between a gate voltage Vg and a source voltage Vs of the drive TFT DR, a data voltage Vdata, a low potential driving voltage Vss, a driving current Ioled, a threshold voltage of the TFT DR Vth, and a constant β determined by mobility and parasitic capacitance of the drive TFT DR.

As indicated in the above Equation 1, the driving current Ioled of the organic light emitting diode OLED is greatly affected by the threshold voltage Vth of the drive TFT DR. When the gate voltages with the same polarity are applied to the gate electrodes of the drive TFT DR for a long time, a gate-bias stress and the threshold voltage Vth of the drive TFT DR increases. Hence, operation characteristics of the drive TFT DR change over time. The changes in the operation characteristics of the drive TFT DR can be seen from an experimental result shown in FIG. 3.

FIG. 3 is a graph showing changes in operation characteristics of hydrogenated amorphous silicon TFT sample (A-Si:H TFT) when a positive gate-bias stress is applied to the hydrogenated amorphous silicon TFT sample (A-Si:H TFT) whose channel width to channel length ratio W/L is 120 μm/6 μm. In FIG. 3, the transverse axis indicates a gate voltage of the A-Si:H TFT, and the vertical axis indicates a current between a source electrode and a drain electrode of the A-Si:H TFT.

More specifically, FIG. 3 shows a threshold voltage of the A-Si:H TFT depending on voltage application time and a movement of the transmission characteristic curve when a voltage of 30 V is applied to a gate electrode of the A-SI:H TFT. As can be seen from FIG. 3, as application time of a positive voltage to the gate electrode of the A-Si:H TFT becomes longer, the transmission characteristic curve of the A-Si:H TFT moves to the right of the graph shown, and the threshold voltage of the A-Si:H TFT rises from a voltage Vth1 to a voltage Vth4.

A rise level of the threshold voltage of the A-Si:H TFT depending on the voltage application time changes in each pixel. For example, a rise width of a threshold voltage of a drive TFT in a first pixel to which a first data voltage is applied for a long time is smaller than a rise width of a threshold voltage of a drive TFT in a second pixel to which a second data voltage larger than the first data voltage is applied for a long time. In this case, the amount of driving current flowing in an organic light emitting diode generated by the same data voltage in the first pixel is more than that of the second pixel. Hence, the display quality is deteriorated.

A method in which a rise in the threshold voltage of the drive TFT is suppressed by applying a negative gate-bias stress to the drive TFT was recently proposed to prevent the deterioration of the display quality. However, it is difficult to completely compensate for a difference between driving currents of the pixels by only applying a negative voltage as pixel data to suppress the rise in the threshold voltage of the drive TFT. As indicated in the above Equation 1, the driving current Ioled flowing in the organic light emitting diode is affected by a potential value of a Vss supply line for supplying the low potential driving voltage Vss and the mobility of the drive TFT DR determining the constant β as well as the threshold voltage of the drive TFT DR. When the driving current flows in each pixel of an OLED display panel, the low potential driving voltage Vss changes depending on a location of the pixel because of a resistance of the Vss supply line. The mobility of the drive TFT DR is also degraded depending on the driving time. Therefore, a difference between the threshold voltages of the drive TFTs DR, a potential difference between the Vss supply lines, and a difference between the mobilities of the drive TFTs DR have to be compensated so that the display quality is improved by reducing a deviation of the driving current of each pixel.

SUMMARY OF THE INVENTION

Accordingly, the present invention is directed to an organic light emitting diode (OLED) display and a method of driving the same that substantially obviates one or more problems due to limitations and disadvantages of the related art.

An object of the present invention is to provide an organic light emitting diode (OLED) display and a method of driving the same that increases the display quality by preventing the deterioration of a driving current caused by the deterioration of a drive thin film transistor (TFT) depending on driving time.

Another object of the present invention is to provide an OLED display and a method of driving the same that minimizes the deterioration of a threshold voltage of a drive TFT.

Yet another object of the present invention is to provide an OLED display and a method of driving the same that increases the display quality by compensating for a difference between threshold voltages of drive TFTs of pixels, a difference between mobilities of the drive TFTs, and a difference between potential values of Vss supply.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an organic light emitting diode display includes a data line, a gate line that crosses the data line to receive a scan pulse, a high potential driving voltage source to generate a high potential driving voltage, a low potential driving voltage source to generate a low potential driving voltage, a light emitting element to emit light due to a current flowing between the high potential driving voltage source and the low potential driving voltage source, a drive element connected between the high potential driving voltage source and the light emitting element to control a current flowing in the light emitting element depending on a voltage between a gate electrode and a source electrode of the drive element, and a driving current stabilization circuit to apply a first voltage to the gate electrode of the drive element to turn on the drive element and to sink a reference current through the drive element to set a source voltage of the drive element at a sensing voltage and to modify the voltage between the gate and source electrodes of the drive element to scale a current to be applied to the light emitting element from the reference current.

In another aspect, a method of driving a organic light emitting diode display including a data line, a gate line that crosses the data line to receive a scan pulse, a high potential driving voltage source to generate a high potential driving voltage, a low potential driving voltage source to generate a low potential driving voltage, a light emitting element to emit light due to a current flowing between the high potential driving voltage source and the low potential driving voltage source, and a drive element connected between the high potential driving voltage source and the light emitting element to control a current flowing in the light emitting element depending on a voltage between a gate electrode and a source electrode of the drive element, the method including applying a first voltage to the gate electrode of the drive element to turn on the drive element, sinking a reference current through the drive element to set a source voltage of the drive element at a sensing voltage, and modifying the voltage between the gate and source electrodes to scale a current to be applied to the light emitting element from the reference current.

In yet another aspect, a drive stabilization circuit for an organic light emitting diode display includes a high potential driving voltage source to generate a high potential driving voltage to be applied to a drive element for driving a light emitting element, a low potential driving voltage source to generate a low potential driving voltage, and a data drive circuit to apply a first voltage to the gate electrode of the drive element to turn on the drive element and to sink a reference current through the drive element to set a source voltage of the drive element at a sensing voltage and to modify the voltage between the gate and source electrodes of the drive element to scale a current to be applied to a light emitting element from the reference current.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to the embodiments of the present invention, examples of which are illustrated in the accompanying drawings.

First Exemplary Embodiment

Because it is difficult to control current data depending on each gray level in an organic light emitting diode (OLED) display, a driving current actually flowing in an OLED is generated by setting a compensation voltage using a relatively high reference current and downscaling the set voltage in accordance with a first exemplary embodiment of the present invention. In the OLED display according to the first exemplary embodiment of the invention, a potential of a source electrode of a drive element is fixed at the set voltage, and a driving current is downscaled by reducing a potential of a gate electrode of the drive element from a reference voltage that is already supplied.

Figure 4:
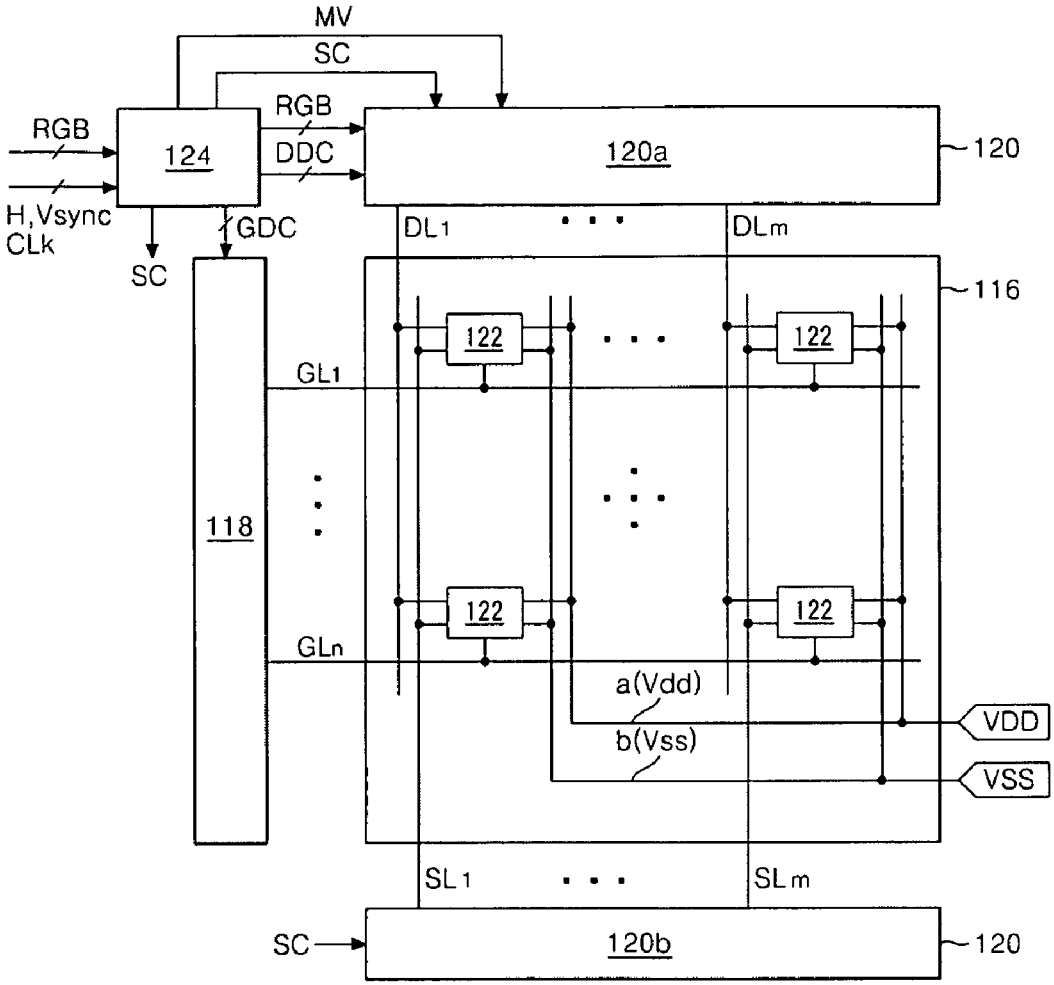
FIG. 4 is a block diagram showing an OLED display according to a first exemplary embodiment of the invention.
Figure 5:
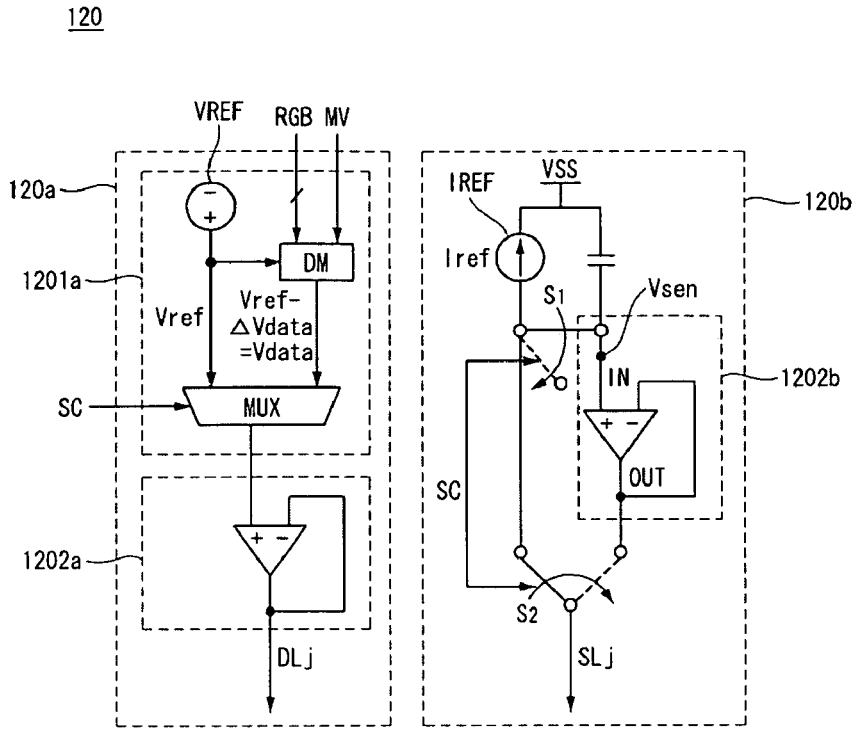
FIG. 5 is a circuit diagram of an exemplary data drive circuit of FIG. 4.

FIG. 4 is a block diagram showing an OLED display according to the first exemplary embodiment of the invention. FIG. 5 is a circuit diagram of an exemplary data drive circuit of FIG. 4.

As shown in FIGS. 4 and 5, the OLED display according to the first exemplary embodiment of the invention includes a display panel 116, a gate drive circuit 118, a data drive circuit 120, and a timing controller 124. The display panel 116 includes m×n pixels 122 at each crossing region of a pair of m data lines DL1 to DLm and m sensing lines SL1 to SLm that are in one-to-one correspondence with each other and n gate lines GL1 to GLn. Signal lines "a" supplying a high potential driving voltage Vdd to each pixel 122 and signal lines "b" supplying a low potential driving voltage Vss to each pixel 122 are formed on the display panel 116. A high potential driving voltage source VDD and a low potential driving voltage source VSS generate the high potential driving voltage Vdd and the low potential driving voltage Vss, respectively.

The gate drive circuit 118 generates scan pulses Sp (FIG. 7) in response to a gate control signal GDC generated by the timing controller 124 to sequentially supply the scan pulses Sp to the gate lines GL1 to GLn. The data drive circuit 120 includes a first data driver 120*a* connected to the data lines DL1 to DLm and a second data driver 120*b* connected to the sensing lines SL1 to SLm. Although FIG. 4 shows the first and second data drivers 120*a* and 120*b* as being separate drivers formed on opposing ends of the display panel 116 for the convenience of explanation, the first and second data drivers 120*a* and 120*b* may be integrated into one data driver.

Figure 7:
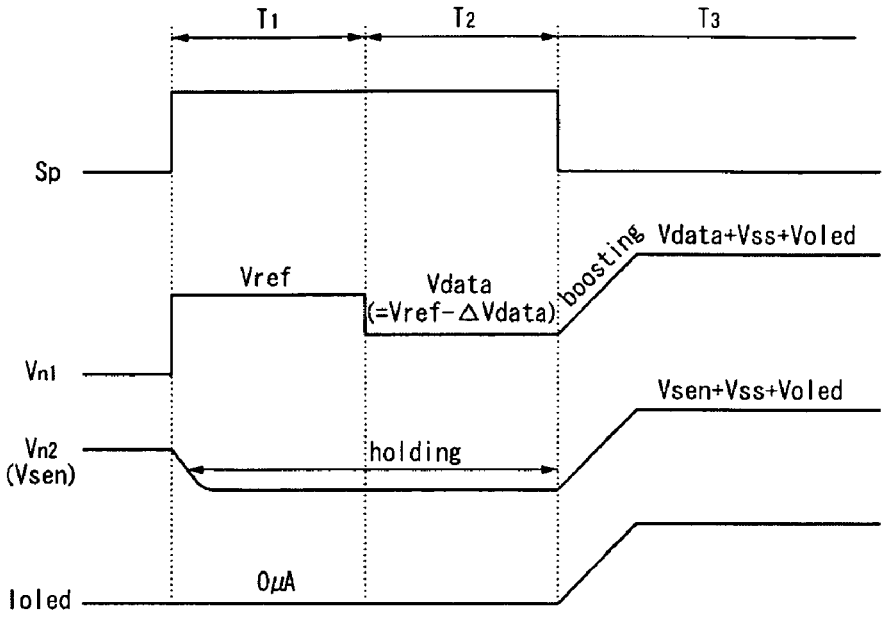
FIG. 7 is an exemplary drive waveform diagram illustrating an operation of a pixel.

The first data driver 120*a* supplies a reference voltage Vref to the data lines DL1 to DLm during a first period T1, and then supplies a data voltage Vdata that is reduced from the reference voltage Vref by a data change amount ΔVdata to the data lines DL1 to DLm during a second period T2, as shown in FIG. 7. As shown in FIG. 5, the first data driver 120*a* includes a data generation unit 1201*a* that generates the reference voltage Vref and the data voltage Vdata, and a first buffer 1202*a* that stabilizes the reference voltage Vref and the data voltage Vdata generated by the data generation unit 1201*a* to output the stabilized reference voltage Vref and the stabilized data voltage Vdata to the j-th data line DLj ($1 \leqq j \leqq m$). The data generation unit 1201*a* includes a reference voltage source VREF, a data modulator DM, and a multiplexer MUX. The reference voltage source VREF generates the reference voltage Vref determined as a voltage between the high potential driving voltage Vdd and the low potential driving voltage Vss. The data modulator DM extracts the data change amount ΔVdata using digital video data RGB supplied by the timing controller 124 and an amount of mobility deviation MV of a drive thin film transistor (TFT) formed inside the pixel 122 depending on driving time. The data change amount ΔVdata is subtracted from the reference voltage Vref to generate the data voltage Vdata. The deviation amount of the mobility MV of the drive TFT in each pixel 122 depending on driving time is previously stored in an external memory. The multiplexer MUX selects and outputs the reference voltage Vref from the reference voltage source VREF in response to a switch control signal SC supplied by the timing controller 124 during the first period T1 and selects and outputs the data voltage Vdata from the data modulator DM during the second period T2. In the first exemplary embodiment, the first period T1 is defined by a first half period of the scan pulse Sp maintained in a high logic voltage state, and the second period T2 is defined by a second half period of the scan pulse Sp maintained in the high logic voltage state.

The second data driver 120*bk* sinks a reference current Iref through the sensing lines SL1 to SLm to set a source voltage of the drive TFT to a sensing voltage Vsen during the first period T1, and keeps the set sensing voltage Vsen constant during the second period T2. As shown in FIG. 5, the second data driver 120*b* includes a reference current source IREF for sinking the reference current Iref, a second buffer 1202*b* for keeping the set sensing voltage Vsen constant, a first switch S1, and a second switch S2. The first switch S1 switches on and off a current path between the reference current source IREF and an input terminal IN of the second buffer 1202*b* in response to the switch control signal SC supplied by the timing controller 124. The second switch S2 switches between a current path of the j-th sensing line SLj ($1 \leqq j \leqq m$) to the reference current source IREF and a current path of the sensing line SLj to an output terminal OUT of the second buffer 1202*b* in response to the switch control signal SC. During the first period T1, the first switch SI forms a current path between the reference current source IREF and the input terminal IN of the second buffer 1202*b*, and the second switch S2 forms the current path between the j-th sensing line SLj and the reference current source IREF. Hence, the set sensing voltage Vsen is applied to the input terminal IN of the second buffer 1202*b*. During the second period T2, the first switch SI cuts off the current path between the reference current source IREF and the input terminal IN of the second buffer 1202*b*, and the second switch S2 forms the current path between the j-th sensing line SLj and the output terminal OUT of the second buffer 1202*b*. Hence, the sensing voltage Vsen is output through the j-th sensing line SLj with a voltage value equal to a voltage value applied to the input terminal IN of the second buffer 1202*b*.

The timing controller 124 supplies a digital video data RGB received from the outside to the data drive circuit 120. The timing controller 124 generates control signals GDC and DDC to control the operation timing of the gate drive circuit 118 and the data drive circuit 120, respectively, using vertical and horizontal sync signals Vsync and Hsync and a clock signal CLK. The timing controller 124 generates the switch control signal SC synchronizing the switches during the first and second periods T1 and T2. The timing controller 124 may include a memory for storing the deviation amount of mobility MV of the drive TFTs in each pixel 122 depending on driving time inside the timing controller 124.

Figure 6:
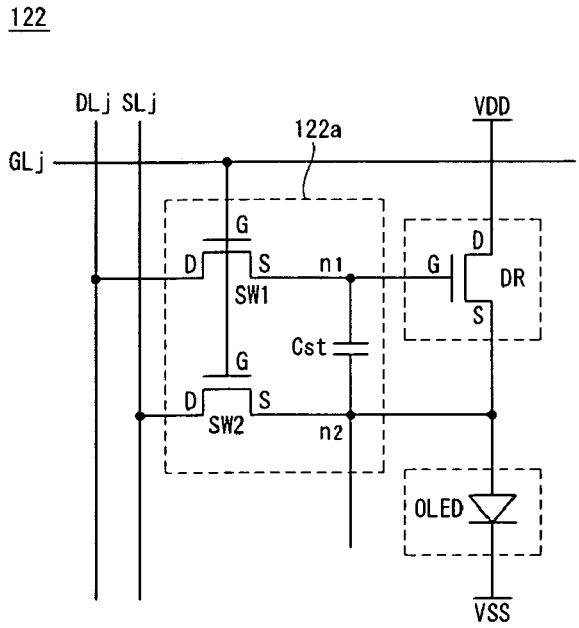
FIG. 6 is an equivalent circuit diagram of an exemplary pixel at a crossing of j-th gate, data, and sensing lines shown in FIG. 4.

As shown in FIG. 6, each pixel 122 includes an organic light emitting diode OLED, a drive TFT DR, two switch TFTs SW1 and SW2, and a storage capacitor Cst. FIG. 6 is an equivalent circuit diagram of an exemplary pixel 122 at a crossing of j-th gate, data, and sensing lines GLj, DLj, and SLj shown in FIG. 4. FIG. 7 is an exemplary drive waveform diagram for explaining an operation of the pixel 122. In FIG. 7, the first period T1 indicates an address period of the reference current Iref, the second period T2 indicates an address period of the data voltage Vdata, and the third period T3 indicates an emitting period.

As shown in FIGS. 6 and 7, the pixel 122 according to the first exemplary embodiment of the invention includes an organic light emitting diode OLED at the crossing region of the j-th gate, data, and sensing lines GLj, DLj, and SLj, a drive TFT DR, and a cell drive circuit 122*a* for driving the organic light emitting diode OLED and the drive TFT DR. The drive TFT DR includes a gate electrode G connected to the cell drive circuit 122*a* through a first node n1, a drain electrode D connected to the high potential driving voltage source VDD, and a source electrode S connected to the cell drive circuit 122*a* through a second node n2. The drive TFT DR controls a current flowing in the organic light emitting diode OLED depending on a voltage difference between a gate voltage applied to the gate electrode G and a source voltage applied to the source electrode S. The drive TFT DR may be an N-type metal-oxide semiconductor field effect transistor (MOSFET). A semiconductor layer of the drive TFT DR may include an amorphous silicon layer.

Figure 1:
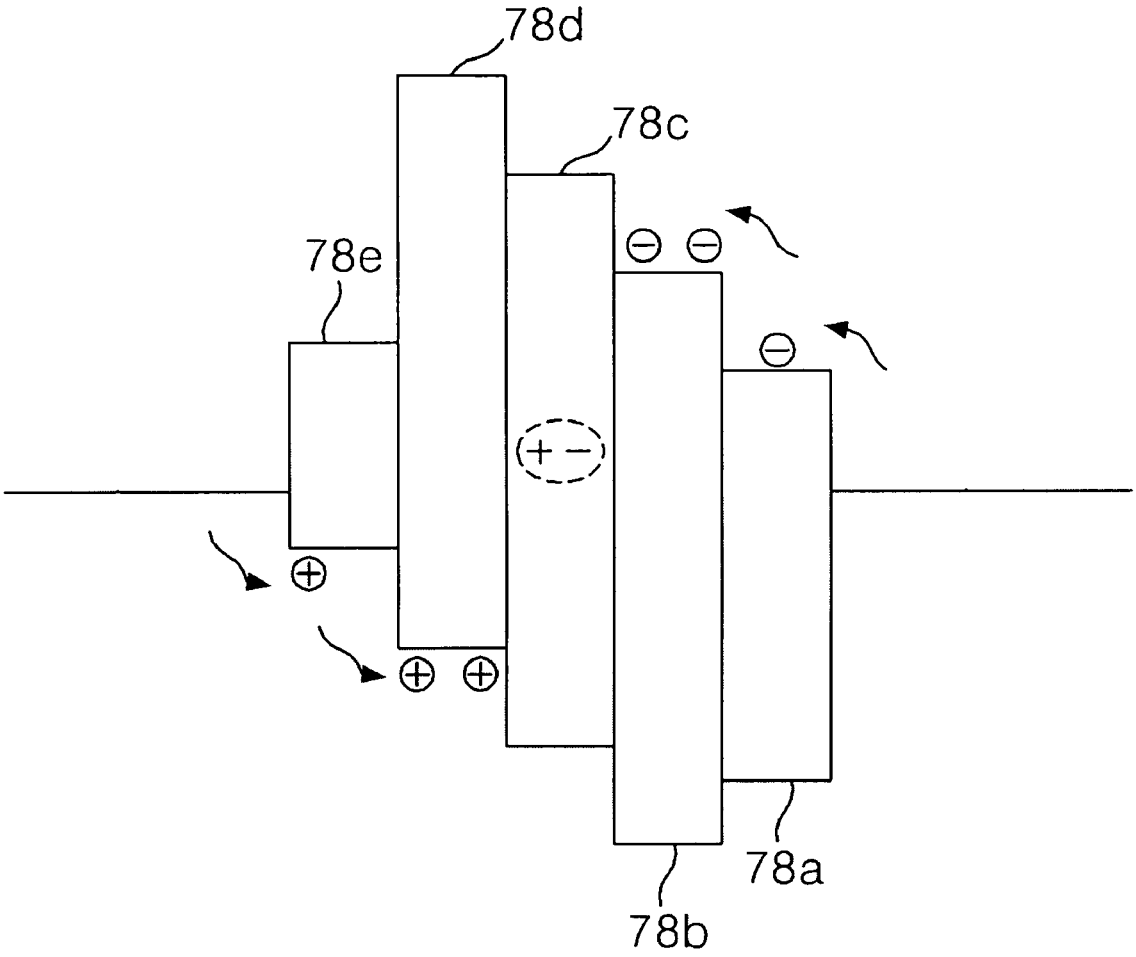
FIG. 1 (Related Art)
FIG. 1 is a diagram illustrating a light emitting principle of a general organic light emitting diode (OLED) display.
Figure 2:
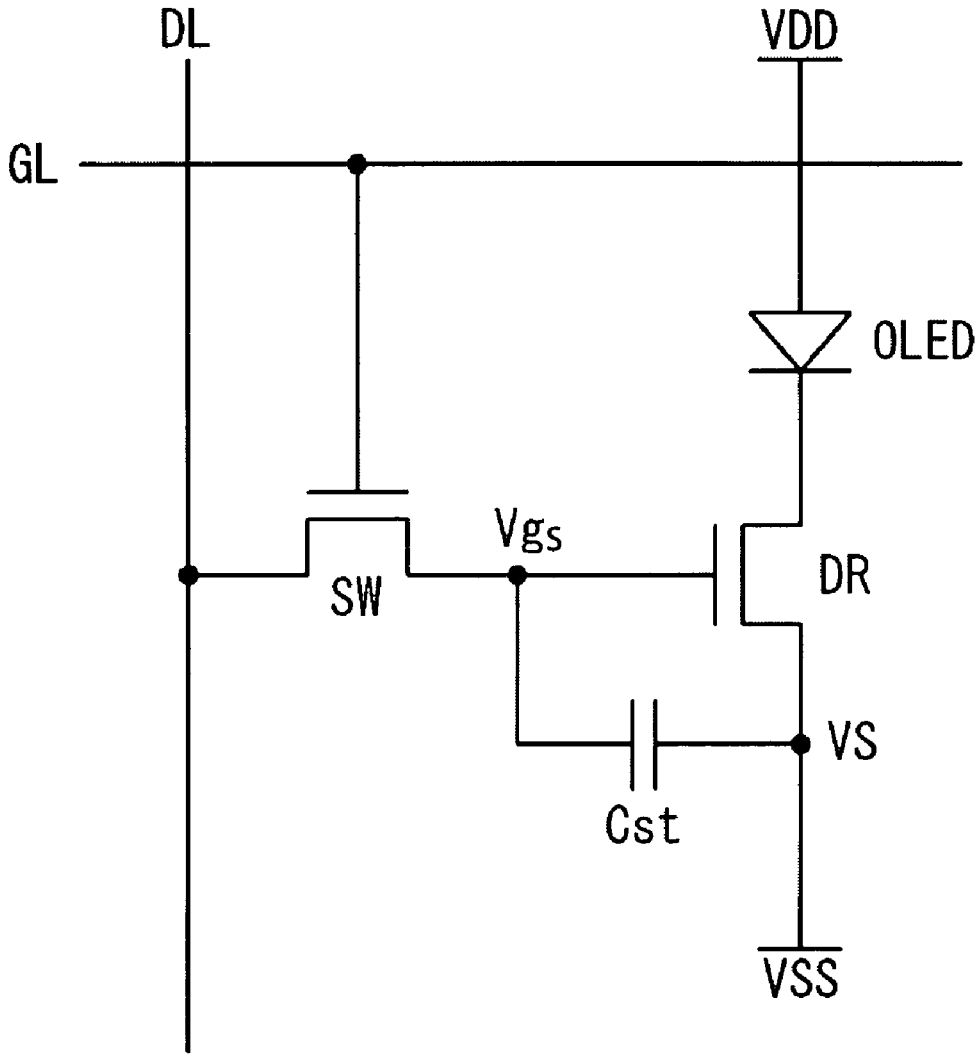
FIG. 2 (Related Art)
FIG. 2 is an equivalent circuit diagram showing one pixel in a related art active matrix type OLED display.
Figure 3:
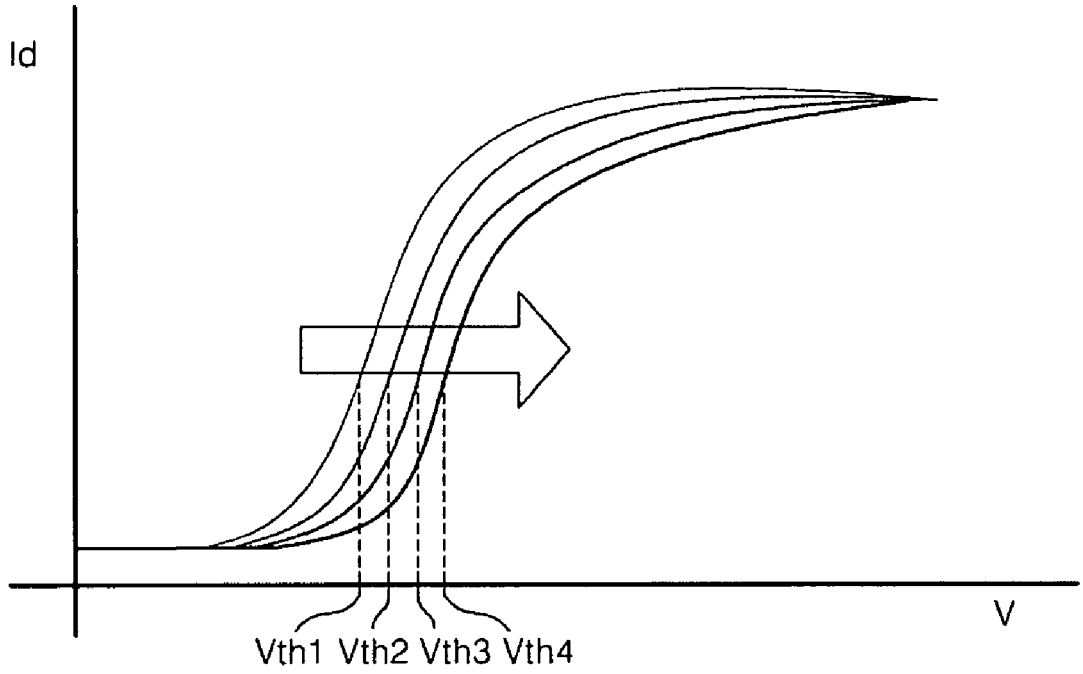
FIG. 3 (Related Art)
FIG. 3 is a graph showing a rise in a threshold voltage of a drive thin film transistor caused by a positive gate-bias stress.

The organic light emitting diode OLED includes an anode electrode commonly connected to the drive TFT DR and the cell drive circuit 122*a* through the second node n2, and a cathode electrode connected to the low potential driving voltage source VSS. The organic light emitting diode OLED has the same structure as the structure shown in FIG. 1 and represents a gray scale of the OLED display by emitting light using the driving current controlled by the drive TFT DR.

The cell drive circuit 122*a* includes the first switch TFT SW1, the second switch TFT SW2, and the storage capacitor Cst. The cell drive circuit 122*a* and the data drive circuit 120 constitute a driving current stabilization circuit that prevents the driving current flowing in the organic light emitting diode OLED depending on driving time from becoming degraded.

During the first period T1, the driving current stabilization circuit including the cell drive circuit 122*a* applies the reference voltage Vref to the gate electrode G of the drive TFT DR to turn on the drive TFT DR and sinks the reference current Iref through the drive TFT DR to set the source voltage of the drive TFT DR to the sensing voltage Vsen. Then, during the second period T2, the driving current stabilization circuit fixes the source voltage of the drive TFT DR to the set sensing voltage Vsen and reduces a potential of the gate electrode G of the drive TFT DR to the data voltage Vdata obtained by subtracting the data change amount ΔVdata from the reference voltage Vref to reduce a voltage between the gate and source electrodes of the drive TFT DR. Then, during the third period T3, the driving current stabilization circuit downscales the current to be applied to the organic light emitting diode OLED.

In particular, the first switch TFT SW1 includes a gate electrode G connected to the j-th gate line GLj, a drain electrode D connected to the first data driver 120*a* through the j-th data line DLj, and a source electrode S connected to the first node n1. The first switch TFT SW1 switches on and off the current path between the j-th data line DLj and the first node n1 in response to the scan pulse Sp. Hence, the first switch TFT SW1 uniformly keeps the potential of the gate electrode G of the drive TFT DR at the reference voltage Vref during the first period T1 and then reduces the potential of the gate electrode G to the data voltage Vdata during the second period T2.

The second switch TFT SW2 includes a gate electrode G connected to the j-th gate line GLj, a drain electrode D connected to the second data driver 120*b* through the j-th sensing line SLj, and a source electrode S connected to the second node n2. The second switch TFT SW2 switches on and off the current path between the j-th sensing line SLj and the second node n2 in response to the scan pulse Sp. Thus, the reference current Iref is sunk through the drive TFT DR and the second switch TFT SW2 during the first period T1. After the source voltage of the drive TFT DR is set at the sensing voltage Vsen by the sink operation of the reference current Iref, the source voltage is kept at the sensing voltage Vsen during the second period T2.

The storage capacitor Cst includes a first electrode connected to the first node n1 and a second electrode connected to the second node n2. During the third period T3 during which the organic light emitting diode OLED emits light, the storage capacitor Cst keeps the voltage between the gate electrode G and the source electrode S of the drive TFT DR set during the first and second periods T1 and T2 constant.

Figure 8A:
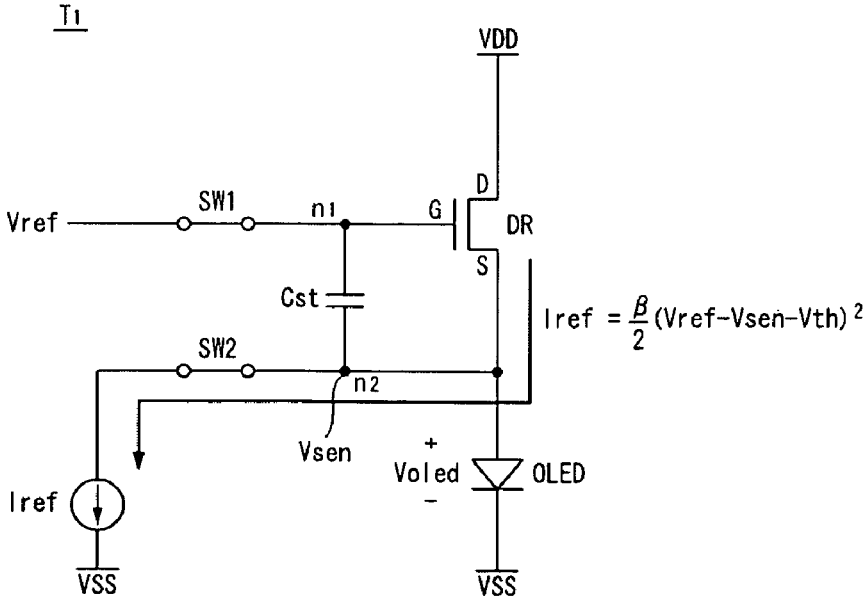
FIG. 8A is an equivalent circuit diagram of an exemplary pixel during a first period.

A detailed operation of the pixel 122 will be described below with reference to FIGS. 7 and 8A to 8C. As shown in FIGS. 7 and 8A, the scan pulse Sp is generated as a high logic voltage during the first period T1. Thus, the first and second switch TFTs SW1 and SW2 are turned on. The reference voltage Vref is applied to the first node n1 by the turned-on first and second switch TFTs SW1 and SW2 Thus, the drive TFT DR is turned on. The reference current Iref is sunk from the high potential driving voltage source VDD to the data drive circuit 120 via the drive TFT DR and the second node n2 by the turned-on drive TFT DR. The reference current Iref is expressed by the following Equation 2:

$$Iref = \frac{\beta}{2}(Vref - Vsen - Vth)^2$$

In the above Equation 2, β indicates a constant determined by the mobility and parasitic capacitance of the drive TFT DR, Vsen indicates the sensing voltage at the second node n2, and Vth indicates a threshold voltage of the TFT DR.

The sensing voltage Vsen at the second node n2 are different in each pixel 122 depending on a characteristic deviation of the TFT DR and a location of the pixel 122. For example, the sensing voltage Vsen at the first pixel is smaller than the sensing voltage Vsen at the second pixel whose threshold voltage Vth of the TFT DR is smaller than the threshold voltage Vth of the TFT DR of the first pixel. Further, the sensing voltage Vsen at the first pixel is smaller than the sensing voltage Vsen at the second pixel whose mobility of the TFT DR is higher than the mobility of the TFT DR of the first pixel. Still further, the sensing voltage Vsen at the first pixel is smaller than the sensing voltage Vsen at the second pixel whose potential of the Vss supply line is lower than a potential of the Vss supply line of the first pixel. As described above, because the sensing voltage Vsen has a different value in each pixel 122 depending on the characteristic deviation of the TFT DR and the location of the pixel 122 inside the display panel 116, a difference between the threshold voltages of the drive TFTs DR of the pixels 122, a difference between the mobilities of the drive TFTs DR, and a potential difference between the Vss supply lines can be compensated. Accordingly, all the pixels 122 are programmed so that the same current flows in the organic light emitting diode OLED in response to the same data voltage.

When the reference current Iref is sunk during the first period T1, the organic light emitting diode OLED has to be turned off. Therefore, a potential of the low potential driving voltage source VSS may be set to be larger than a voltage value obtained by subtracting the threshold voltage Vth of the TFT DR and a threshold voltage Voled of the organic light emitting diode OLED from the reference voltage Vref. The organic light emitting diode OLED remains in a turn-off state during the second period T2.

Figure 8B:
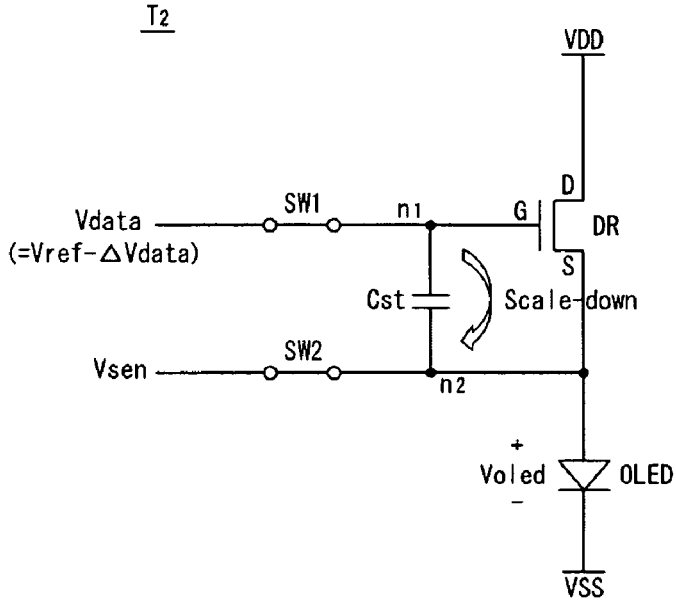
FIG. 8B is an equivalent circuit diagram of an exemplary pixel during a second period.

As shown in FIGS. 7 and 8B, the scan pulse Sp remains in a high logic voltage state during the second period T2, and thus the first and second switch TFTs SW1 and SW2 remain in a turn-on state. While the data drive circuit 120 uniformly maintains the potential of the second node n2 at the sensing voltage Vsen, the data drive circuit 120 allows the potential of the first node n1 to be the data voltage Vdata obtained by subtracting the data change amount ΔVdata from the reference voltage Vref. In other words, the potential of the first node n1 during the second period T2 is lower than the potential of the first node n1 during the first period T1. The reason why voltage between the gate and source electrodes of the drive TFT DR is reduced by lowering the potential of the first node n1 during the second period T2 is to change the current to be applied to the organic light emitting diode OLED from the reference current Iref to a driving current level corresponding to an actual gray level. The storage capacitor Cst keeps the downscaled voltage between the gate and source electrodes of the drive TFT DR constant, thereby keeping the programmed current constant.

Figure 8C:
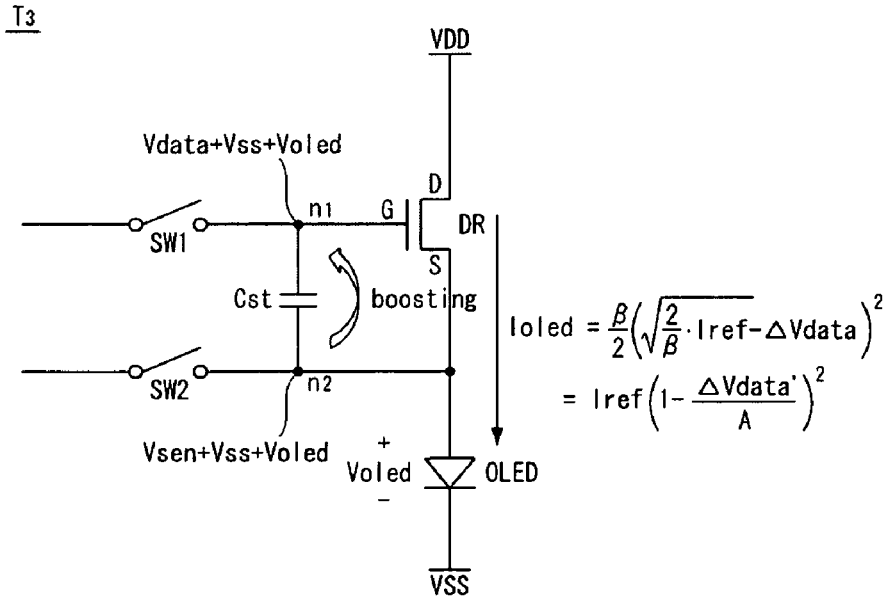
FIG. 8C is an equivalent circuit diagram of an exemplary pixel during a third period.

As shown in FIGS. 7 and 8C, the scan pulse Sp is switched to a low logic voltage state during the third period T3. Thus, the first and second switch TFTs SW1 and SW2 are turned off. Although the first and second switch TFTs SW1 and SW2 are turned off, the programmed current, namely, the downscaled current still flows between the gate and source electrodes of the drive TFT DR. The downscaled current allows the potential at the second node n2 connected to the anode electrode of the organic light emitting diode OLED to increase from the sensing voltage Vsen by an amount equal to or larger than a sum of the threshold voltage Voled of the organic light emitting diode OLED and the low potential driving voltage Vss (i.e., Vsen+Vss+Voled). Thus, the organic light emitting diode OLED is turned on. When the potential of the second node n2 rises, the potential of the first node n1 also rises by the same amount (Vss+Voled) as a rise width of the potential of the second node n2 due to a boosting effect of the storage capacitor Cst. As a result, the current programmed during the second period T2 is continuously maintained during the third period T3.

The current Ioled flowing in the organic light emitting diode OLED during the third period T3 is expressed by the following Equation 3:

$$Ioled = \frac{\beta}{2}(Vref - \Delta Vdata - Vsen - Vth)^2$$

The current Ioled flowing in the organic light emitting diode OLED is expressed by the following Equation 4 by substituting Equation 2 in Equation 3.

$$Vref = Vsen - Vth = \sqrt{\frac{2}{\beta}Iref} \quad (1)$$

-continued $$Ioled = \frac{\beta}{2}\left(\sqrt{\frac{2}{\beta}Iref} - \Delta Vdata\right)^2 \quad (2)$$

As indicated in the above Equation 4(2), the current Ioled flowing in the organic light emitting diode OLED depends on the reference current Iref and the data change amount ΔVdata. In other words, the current Ioled is not affected by a change in the threshold voltage Vth of the drive TFT DR. However, because the constant β determined by the mobility of the drive TFT DR remains in the above equation 4(2), the current Ioled flowing in the organic light emitting diode OLED is affected by a deviation of the mobility between the drive TFTs DR of the pixels. To compensate for the deviation, when the data change amount ΔVdata is extracted using the data drive circuit, the deviation amount of mobility MV of the drive TFT DR depending on driving time has to be considered. In other words, the constant β has to be eliminated from the data change amount ΔVdata.

Accordingly, Equation 4(1) may be abbreviated and expressed as the following Equation 5:

$$y = const. - \sqrt{\frac{2}{\beta}}\,x,\ (y = Vsen,\ x = \sqrt{Iref})$$

Figure 9:
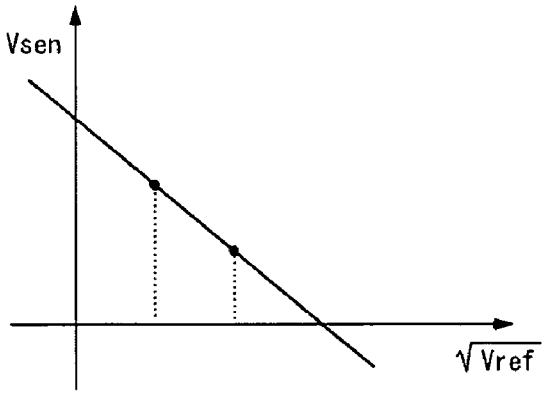
FIG. 9 is a diagram illustrating the calculation of a deviation amount of a mobility of a drive thin film transistor depending on driving time.

As indicated in the above Equation 5, the deviation amount of mobility MV of the drive TFT DR depending on driving time results in a slope of a functional formula. Accordingly, as shown in FIG. 9, if two predetermined values on an X-axis are selected, values on the Y-axis can be obtained through the above Equation 5. As a result, a described slope can be calculated. Because the calculated slope may be different for each pixel, the slopes are stored in the memory in the form of a lookup table, and the slope lookup table is used to extract the data change amount ΔVdata using the data drive circuit during the second period T2. The current Ioled flowing in the organic light emitting diode OLED in which the slope is included in the data change amount ΔVdata is expressed by the following Equation 6, where A is a constant:

$$Ioled = Iref\left(1 - \frac{\Delta Vdata'}{A}\right)^2,\ \left(\Delta Vdata' = \frac{A}{\sqrt{\frac{2}{\beta}Iref}}\Delta Vdata\right)$$

As indicated in the above Equation 6, the current Ioled flowing in the organic light emitting diode OLED is not affected by the deviation between the mobilities of the drive TFTs DR of the pixels since the constant β has been eliminated from the data change amount ΔVdata.

As described above, while it is difficult to control the current data depending on each gray level in the OLED display, the driving current actually flowing in the organic light emitting diode may be adjusted by setting a compensation voltage using a relatively high reference current and downscaling the set voltage according to the first exemplary embodiment of the present invention.

Although not shown in the OLED display according to the first exemplary embodiment of the invention described above, the driving current actually flowing in the organic light emitting diode may be formed by setting a compensation voltage using a relatively low reference current and upscaling the set voltage in an alternative embodiment, so as to reduce the output deviation and the load amount of the second data drivers for applying a high reference current under a large area. In this case, the potential of the source electrode of the drive element may be fixed at the set voltage, and the potential of the gate electrode of the drive element may be increased from the previously supplied reference voltage, thereby upscaling the driving current.

Second Exemplary Embodiment

The OLED display according to a second exemplary embodiment of the present invention fixes a potential of a gate electrode of a drive element at a reference voltage and sets a potential of a source electrode of the drive element to a compensation voltage and at the same time raises the set voltage, thereby downscaling the driving current.

Figure 10:
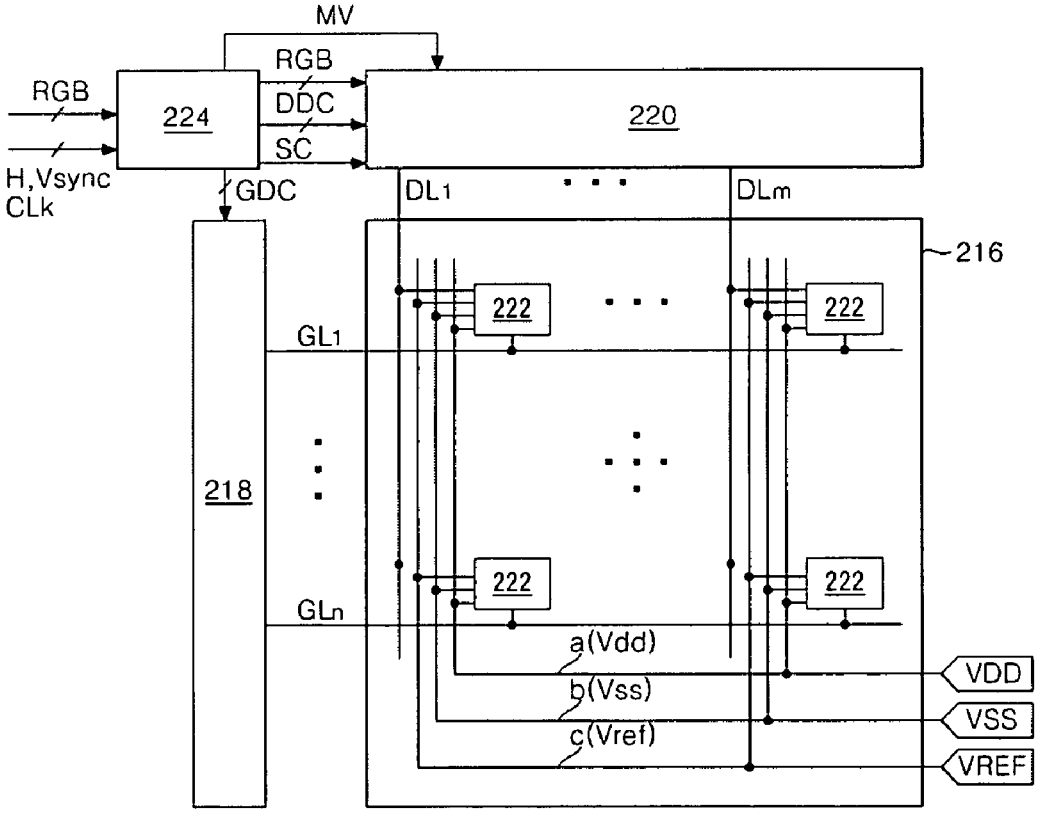
FIG. 10 is a block diagram showing an OLED display according to a second exemplary embodiment of the invention.
Figure 11:
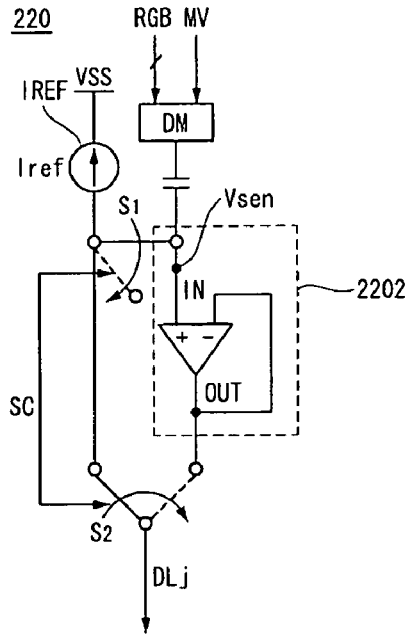
FIG. 11 is a circuit diagram of an exemplary data drive circuit of FIG. 10.

FIG. 10 is a block diagram showing an OLED display according to the second exemplary embodiment of the invention. FIG. 11 is a circuit diagram of an exemplary data drive circuit of FIG. 10.

As shown in FIGS. 10 and 11, the OLED display according to the second exemplary embodiment of the invention includes a display panel 216, a gate drive circuit 218, a data drive circuit 220, and a timing controller 224. The display panel 216 includes m×n pixels 222 at each crossing region of m data lines DL1 to DLm and n gate lines GL1 to GLn. Signal lines "a" supplying a high potential driving voltage Vdd to each pixel 222, signal lines "b" supplying a low potential driving voltage Vss to each pixel 222, and signal lines "c" supplying a reference voltage Vref to each pixel 222 are formed on the display panel 216. A high potential driving voltage source VDD, a low potential driving voltage source VSS, and a reference voltage source VREF generate the high potential driving voltage Vdd, the low potential driving voltage Vss, and the reference voltage Vref, respectively.

Figure 13:
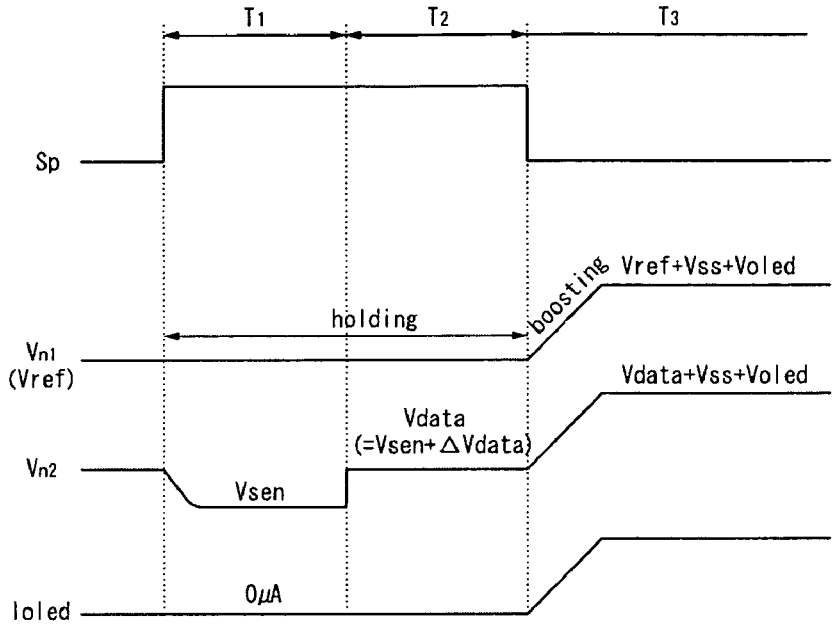
FIG. 13 is an exemplary drive waveform diagram illustrating an operation of a pixel.

The gate drive circuit 218 generates scan pulses Sp (FIG. 13) in response to a gate control signal GDC generated by the timing controller 224 to sequentially supply the scan pulses Sp to the gate lines GL1 to GLn. The data drive circuit 220 sinks a reference current Iref through the data lines DL1 to DLm to set a source voltage of a drive TFT formed inside the pixel 222 at a sensing voltage Vsen during a first period T1, as shown in FIG. 13. During a second period T2, the data drive circuit 220 keeps the set sensing voltage Vsen constant, and at the same time, supplies a data voltage Vdata is increased from the sensing voltage Vsen by a data change amount ΔVdata to the data lines DL1 to DLm.

As shown in FIG. 11, the data drive circuit 220 includes a reference current source IREF for sinking the reference current Iref, a buffer 2202 for keeping the set sensing voltage Vsen constant, a data modulator DM generating the data voltage Vdata is increased from the sensing voltage Vsen by the data change amount ΔVdata, a first switch S1, and a second switch S2. The first switch S1 switches on and off a current path between the reference current source IREF and an input terminal IN of the buffer 2202 in response to a switch control signal SC supplied by the timing controller 224. The second switch S2 switches between a current path of the j-th data line DLj (1≦j≦m) to the reference current source IREF and a current path of the data line DLj to an output terminal OUT of the buffer 2202 in response to the switch control signal SC.

The data modulator DM extracts the data change amount ΔVdata using digital video data RGB supplied by the timing controller 224 and a deviation amount of mobility MV of the drive TFT depending on driving time. The sensing voltage Vsen is then added to the data change amount ΔVdata to generate the data voltage Vdata. The deviation amount of mobility MV of the drive TFT in each pixel 222 depending on driving time is previously stored in an external memory in the form of a lookup table.

During the first period T1, the first switch S1 forms a current path between the reference current source IREF and the input terminal IN of the buffer 2202, and the second switch S2 forms a current path between the data line DLj and the reference current source IREF. Hence, the set sensing voltage Vsen is applied to the input terminal IN of the buffer 2202. During the second period T2, the first switch S1 cuts off the current path between the reference current source IREF and the input terminal IN of the buffer 2202, and the second switch S2 forms a current path between the data line DLj and the output terminal OUT of the buffer 2202. Hence, the sensing voltage Vsen held by the buffer 2202 is added to the data change amount ΔVdata obtained from the data modulator DM, and the added voltage is applied to the data line DLj. During the first and second periods T1 and T2, the reference voltage Vref is uniformly supplied to the reference voltage supply line "c."

The timing controller 224 supplies the digital video data RGB received from the outside to the data drive circuit 220. The timing controller 224 generates control signals GDC and DDC to control the operation timing of the gate drive circuit 218 and the data drive circuit 220, respectively, using vertical and horizontal sync signals Vsync and Hsync and a clock signal CLK. The timing controller 224 generates the switch control signal SC synchronized during the first and second periods T1 and T2. The timing controller 224 may include a memory for storing the deviation amount of mobility MV of the drive TFT in each pixel 222 inside the timing controller 224 depending on driving time.

Figure 12:
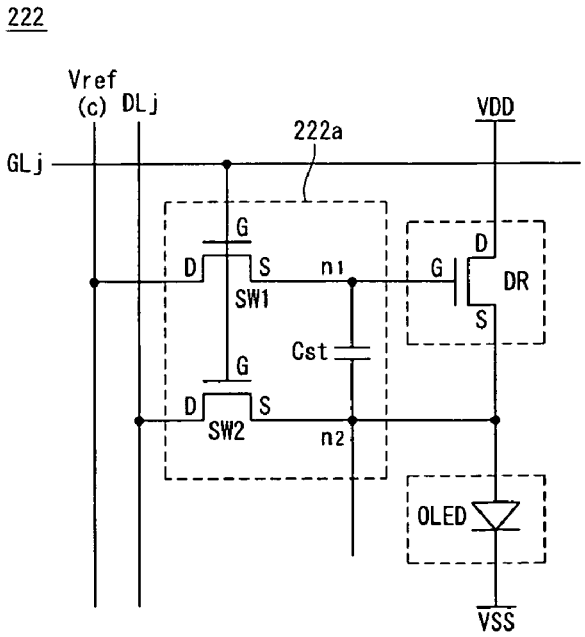
FIG. 12 is an equivalent circuit diagram of an exemplary pixel at a crossing of j-th gate and data lines shown in FIG. 10.

As shown in FIG. 12, each pixel 222 includes an organic light emitting diode OLED, a drive TFT DR, two switch TFTs SW1 and SW2, and a storage capacitor Cst. FIG. 12 is an equivalent circuit diagram of an exemplary pixel 222 at a crossing of the j-th gate and data lines shown in FIG. 10. FIG. 13 is an exemplary drive waveform diagram for explaining an operation of the pixel 222. In FIG. 13, the first period T1 indicates an address period of the reference current Iref, the second period T2 indicates an address period of the data voltage Vdata, and the third period T3 indicates an emitting period.

As shown in FIGS. 12 and 13, the pixel 222 according to the second exemplary embodiment of the invention includes an organic light emitting diode OLED at the crossing region of the j-th gate and data lines GLj and DLj, a drive TFT DR, and a cell drive circuit 222*a* for driving the organic light emitting diode OLED and the drive TFT DR. The drive TFT DR includes a gate electrode G connected to the cell drive circuit 222*a* through a first node n1, a drain electrode D connected to the high potential driving voltage source VDD, and a source electrode S connected to the cell drive circuit 222*a* through a second node n2. The drive TFT DR controls a current flowing in the organic light emitting diode OLED depending on a voltage difference between a gate voltage applied to the gate electrode G and a source voltage applied to the source electrode S. The drive TFT DR may be an N-type metal-oxide semiconductor field effect transistor (MOSFET). A semiconductor layer of the drive TFT DR may include an amorphous silicon layer.

The organic light emitting diode OLED includes an anode electrode commonly connected to the drive TFT DR and the cell drive circuit 222*a* through the second node n2, and a cathode electrode connected to the low potential driving voltage source VSS. The organic light emitting diode OLED has the same structure as the structure shown in FIG. 1 and represents a gray scale of the OLED display by emitting light using the driving current controlled by the drive TFT DR.

The cell drive circuit 222*a* includes the first switch TFT SW1, the second switch TFT SW2, and the storage capacitor Cst. The cell drive circuit 222*a* and the data drive circuit 220 constitute a driving current stabilization circuit that prevents the driving current flowing in the organic light emitting diode OLED depending on driving time from being degraded.

During the first period T1, the driving current stabilization circuit including the cell drive circuit 222*a* applies the reference voltage Vref to the gate electrode G of the drive TFT DR to turn on the drive TFT DR and sinks the reference current Iref through the drive TFT DR to set the source voltage of the drive TFT DR to the sensing voltage Vsen. Then, during the second period T2, the driving current stabilization circuit fixes the gate voltage of the drive TFT DR to the reference voltage Vref and raises a potential of the source electrode S of the drive TFT DR to the data voltage Vdata obtained by adding the sensing voltage Vsen to the data change amount ΔVdata to reduce a voltage between the gate and source electrodes of the drive TFT DR. Then, during the third period T3, the driving current stabilization circuit downscales the current to be applied to the organic light emitting diode OLED in conformity with the gray scale.

The first switch TFT SW1 includes a gate electrode G connected to the j-th gate line GLj, a drain electrode D connected to the reference voltage source VREF through the reference voltage supply line "c," and a source electrode S connected to the first node n1. The first switch TFT SW1 switches on and off the current path between the reference voltage supply line "c" and the first node n1 in response to the scan pulse Sp. Hence, the first switch TFT SW1 uniformly keeps the potential of the gate electrode G of the drive TFT DR at the reference voltage Vref during the first and second periods T1 and T2.

The second switch TFT SW2 includes a gate electrode G connected to the j-th gate line GLj, a drain electrode D connected to the data drive circuit 220 through the j-th data line DLj, and a source electrode S connected to the second node n2. The second switch TFT SW2 switches on and off the current path between the j-th data line DLj and the second node n2 in response to the scan pulse Sp. Thus, the reference current Iref is sunk through the drive TFT DR and the second switch TFT SW2 during the first period T1. The second switch TFT SW2 raises the potential of the source electrode S of the drive TFT DR from the sensing voltage Vsen set by the reference current Iref to the data voltage Vdata during the second period T2.

The storage capacitor Cst includes a first electrode connected to the first node n1 and a second electrode connected to the second node n2. During the third period T3 in which the organic light emitting diode OLED emits light, the storage capacitor Cst keeps the voltage between the gate and source electrodes of the drive TFT DR set during the first and second periods T1 and T2 constant.

Figure 14A:
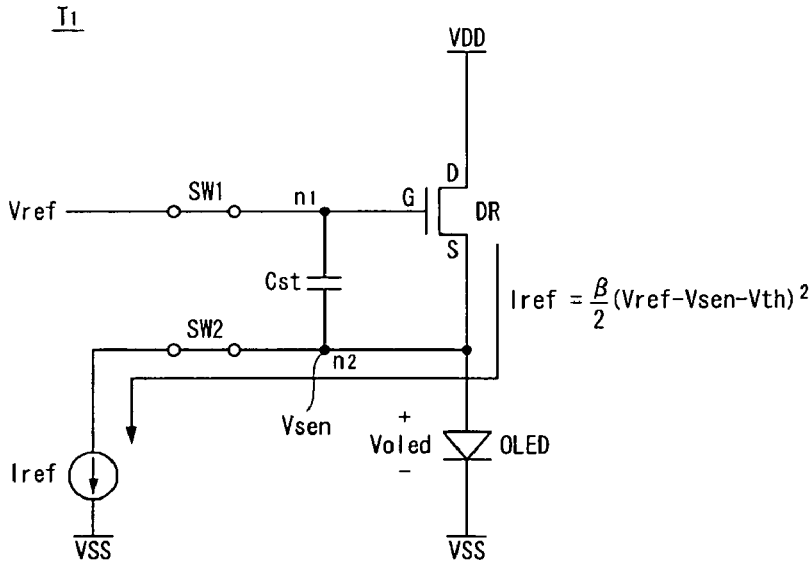
FIG. 14A is an equivalent circuit diagram of an exemplary pixel during a first period.

A detailed operation of the pixel 222 will be described below with reference to FIGS. 13 and 14A to 14C. As shown in FIGS. 13 and 14A, the scan pulse Sp is generated as a high logic voltage during the first period T1. Thus, the first and second switch TFTs SW1 and SW2 are turned on. The reference voltage Vref is applied to the first node n1 by the turned-on first and second switch TFTs SW1 and SW2. Thus, the drive TFT DR is turned on. The reference current Iref expressed by the above Equation 2 is sunk from the high potential driving voltage source VDD to the data drive circuit 220 via the drive TFT DR and the second node n2 by the turned-on drive TFT DR.

The sensing voltage Vsen at the second node n2 are different in each pixel 222 depending on a characteristic deviation of the TFT DR and a location of the pixel 222 inside the display panel 216. For example, the sensing voltage Vsen at the first pixel is smaller than the sensing voltage Vsen at the second pixel whose threshold voltage Vth of the TFT DR is smaller than the threshold voltage Vth of the TFT DR of the first pixel. Further, the sensing voltage Vsen at the first pixel is smaller than the sensing voltage Vsen at the second pixel whose mobility of the TFT DR is higher than the mobility of the TFT DR of the first pixel. Still further, the sensing voltage Vsen at the first pixel is smaller than the sensing voltage Vsen at the second pixel whose potential of the Vss supply line is lower than a potential of the Vss supply line of the first pixel. As described above, because the sensing voltage Vsen has a different value in each pixel 222 depending on the characteristic deviation of the TFT DR and the location of the pixel 222 inside the display panel 216, a difference between the threshold voltages of the drive TFTs DR of the pixels 222, a difference between the mobilities of the drive TFTs DR, and a potential difference between the Vss supply lines can be compensated. Accordingly, all the pixels 222 are programmed so that the same current flows in the organic light emitting diode OLED in response to the same data voltage.

When the reference current Iref is sunk during the first period T1, the organic light emitting diode OLED has to be turned off at a bias operation point. Therefore, a potential of the low potential driving voltage source VSS may be set to be larger than a voltage value obtained by subtracting the threshold voltage Vth of the TFT DR and a threshold voltage Voled of the organic light emitting diode OLED from the reference voltage Vref. The organic light emitting diode OLED remains in the turn-off state during the second period T2.

Figure 14B:
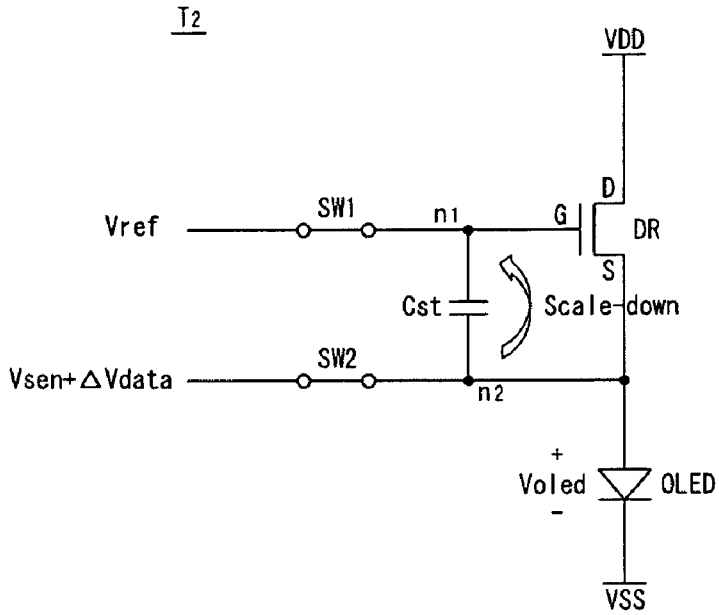
FIG. 14B is an equivalent circuit diagram of an exemplary pixel during a second period.

As shown in FIGS. 13 and 14B, the scan pulse Sp remains in a high logic voltage state during the second period T2, and thus the first and second switch TFTs SW1 and SW2 remain in a turn-on state. While the reference voltage source VREF uniformly maintains a potential of the first node n1 at the reference voltage Vref, the data drive circuit 220 allows a potential of the second node n2 to be the data voltage Vdata obtained by addling the sensing voltage Vsen to the data change amount ΔVdata. In other words, the potential of the second node n2 during the second period T2 is higher than the potential of the second node n2 during the first period T1. The reason why voltage between the gate and source electrodes of the drive TFT DR is reduced by raising the potential of the second node n2 during the second period T2 is to change the current to be applied to the organic light emitting diode OLED from the reference current Iref to a driving current level corresponding to an actual gray level. The storage capacitor Cst keeps the downscaled voltage between the gate and source electrodes of the drive TFT DR constant, thereby keeping the programmed current constant.

Figure 14C:
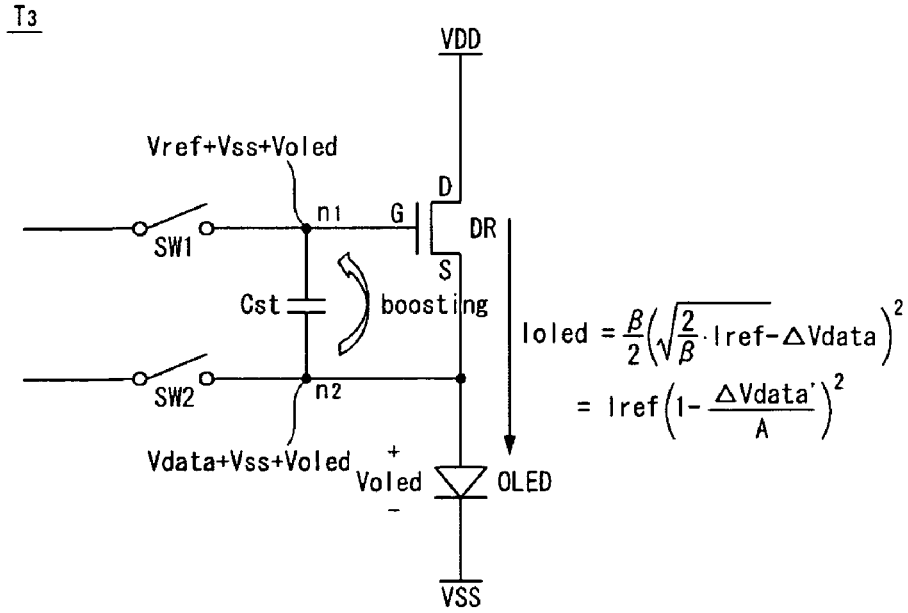
FIG. 14C is an equivalent circuit diagram of an exemplary pixel during a third period.

As shown in FIGS. 13 and 14C, the scan pulse Sp is switched to a low logic voltage state during the third period T3. Thus, the first and second switch TFTs SW1 and SW2 are turned off. Although the first and second switch TFTs SW1 and SW2 are turned off, the programmed current, namely, the downscaled current still flows between the gate and source electrodes of the drive TFT DR. The downscaled current allows a potential at the second node n2 connected to the anode electrode of the organic light emitting diode OLED to increase from the data voltage Vdata by an amount equal to or larger than a sum of the threshold voltage Voled of the organic light emitting diode OLED and the low potential driving voltage Vss (i.e., Vdata+Vss+Voled), and thus the organic light emitting diode OLED is turned on. When the potential of the second node n2 rises, a potential of the first node n1 also rises by the same amount (Vss+Voled) as a rise width of the potential of the second node n2 due to a boosting effect of the storage capacitor Cst. As a result, the current programmed during the second period T2 is continuously maintained during the third period T3. The current Ioled flowing in the organic light emitting diode OLED during the third period T3 is expressed by the above Equations 3 and 4(2).

After the above Equations 5 and 6 are processed, the current Ioled flowing in the organic light emitting diode OLED is not affected by the deviation between the mobilities of the drive TFTs DR of the pixels since the constant β has been eliminated from the data change amount ΔVdata.

As described above, while it is difficult to control the current data depending on each gray level in the OLED display, the driving current actually flowing in the organic light emitting diode may be adjusted by setting a compensation voltage using the relatively high reference current and downscaling the set voltage according to the second exemplary embodiment of the present invention.

Although it is not shown in the OLED display according to the second exemplary embodiment of the invention described above, in an alternative embodiment, the driving current actually flowing in the organic light emitting diode may be formed by setting a compensation voltage using a relatively low reference current and upscaling the set voltage, so as to reduce the output deviation and the load amount of the data drive circuits for applying a high reference current under a large area. In this case, the potential of the gate electrode of the drive element may be fixed at the reference voltage, and the potential of the source electrode of the drive element may be set at a compensation voltage and at the same time the set voltage may be lowered, thereby upscaling the driving current.

Third Exemplary Embodiment

The OLED display according to a third exemplary embodiment of the present invention fixes a potential of a gate electrode of a drive element at a high potential driving voltage and sets a potential of a source electrode of the drive element at a compensation voltage and at the same time raises the set voltage, thereby downscaling a driving current.

Figure 15:
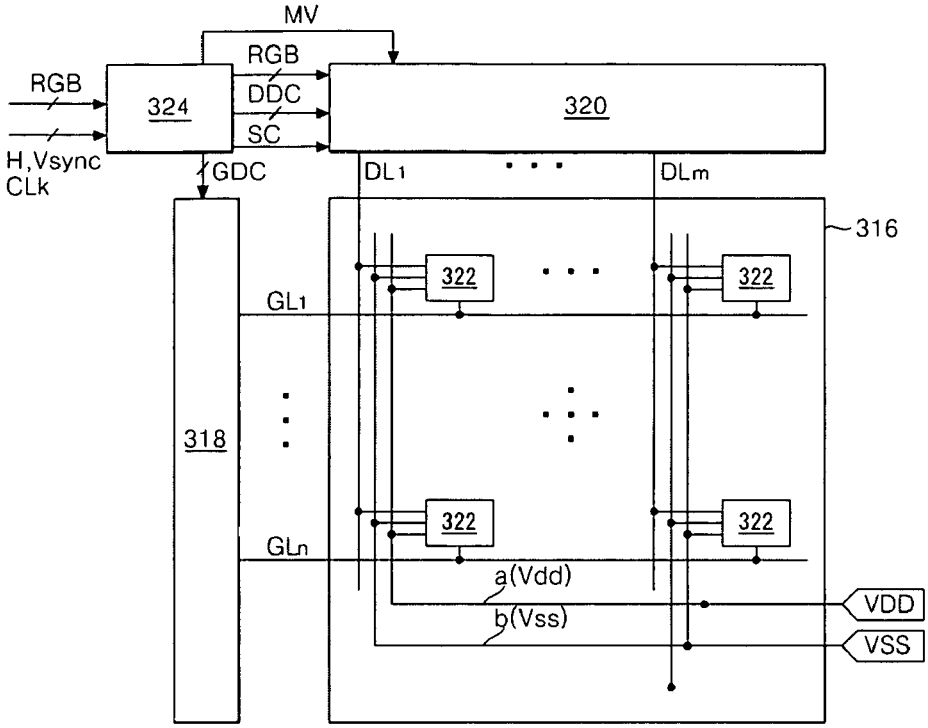
FIG. 15 is a block diagram showing an OLED display according to a third exemplary embodiment of the invention.

FIG. 15 is a block diagram showing an OLED display according to the third exemplary embodiment of the invention. As shown in FIG. 15, the OLED display according to the third exemplary embodiment of the invention includes a display panel 316, a gate drive circuit 318, a data drive circuit 320, and a timing controller 324. The OLED display according to the third exemplary embodiment of the invention is different from the OLED display according to the second exemplary embodiment of the invention in that the connection structure of a cell drive circuit inside a pixel is different from each other, and a reference voltage source generating a reference voltage and signal lines supplying the reference voltage are not necessary. Since functions and operations of the gate drive circuit 318, the data drive circuit 320, and the timing controller 324 are the same as those of the OLED display according to the second exemplary embodiment of the invention, a description thereof is not repeated.

Figure 16:
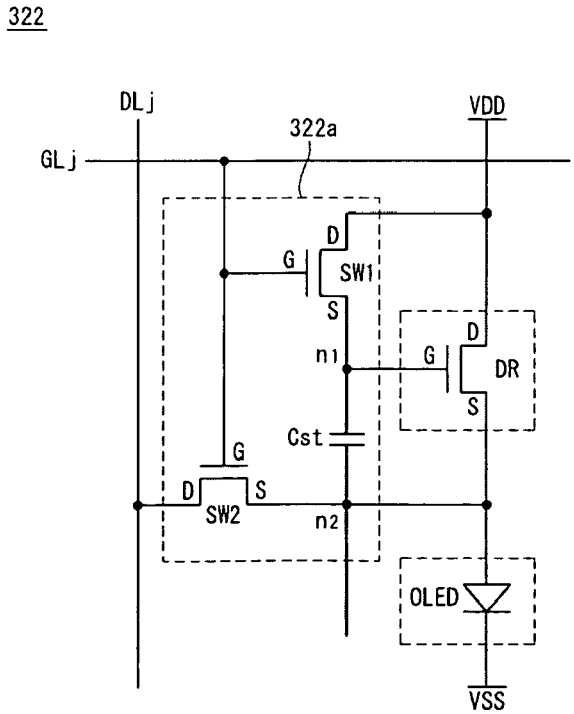
FIG. 16 is an equivalent circuit diagram of an exemplary pixel at a crossing of j-th gate and data lines shown in FIG. 15.

FIG. 16 is an equivalent circuit diagram of an exemplary pixel at a crossing of j-th gate and data lines shown in FIG. 15. As shown in FIG. 16, each pixel 322 formed inside the display panel 316 includes an organic light emitting diode OLED, a drive TFT DR, two switch TFTs SW1 and SW2, and a storage capacitor Cst. The pixel 322 according to the third exemplary embodiment of the invention includes an organic light emitting diode OLED at a crossing of the j-th gate and data lines GLj and DLj, a drive TFT DR, and a cell drive circuit 322*a* for driving the organic light emitting diode OLED and the drive TFT DR.

The drive TFT DR includes a gate electrode G connected to the cell drive circuit 322*a* through a first node n1, a drain electrode D connected to a high potential driving voltage source VDD, and a source electrode S connected to the cell drive circuit 322*a* through a second node n2. The drive TFT DR controls a current flowing in the organic light emitting diode OLED depending on a voltage difference between a gate voltage applied to the gate electrode G and a source voltage applied to the source electrode S. The drive TFT DR may be an N-type metal-oxide semiconductor field effect transistor (MOSFET). A semiconductor layer of the drive TFT DR may include an amorphous silicon layer.

The organic light emitting diode OLED includes an anode electrode commonly connected to the drive TFT DR and the cell drive circuit 322*a* through the second node n2, and a cathode electrode connected to a low potential driving voltage source VSS. The organic light emitting diode OLED has the same structure as the structure shown in FIG. 1 and represents a gray scale of the OLED display by emitting light using a driving current controlled by the drive TFT DR.

The cell drive circuit 322*a* includes the first switch TFT SW1, the second switch TFT SW2, and the storage capacitor Cst. The cell drive circuit 322*a* and the data drive circuit 320 constitute a driving current stabilization circuit that prevents the driving current flowing in the organic light emitting diode OLED depending on driving time from being degraded.

During a first period T1 shown in FIG. 13, the driving current stabilization circuit including the cell drive circuit 322*a* applies a high potential driving voltage VDD to the gate electrode G of the drive TFT DR to turn on the drive TFT DR and sinks a reference current Iref through the drive TFT DR to set the source voltage of the drive TFT DR at a sensing voltage Vsen. Then, during a second period T2, the driving current stabilization circuit fixes the gate voltage of the drive TFT DR to the high potential driving voltage VDD and raises a potential of the source electrode S of the drive TFT DR to a data voltage Vdata obtained by adding the sensing voltage Vsen to a data change amount ΔVdata to reduce a voltage between the gate and source electrodes of the drive TFT DR. Then, during a third period T3, the driving current stabilization circuit downscales a current to be applied to the organic light emitting diode OLED in conformity with the gray scale.

The first switch TFT SW1 includes a gate electrode G connected to the j-th gate line GLj, a drain electrode D connected to the high potential driving voltage source VDD, and a source electrode S connected to the first node n1. The first switch TFT SW1 switches on and off a current path between the high potential driving voltage source VDD and the first node n1 in response to a scan pulse Sp. Hence, the first switch TFT SW1 uniformly keeps the potential of the gate electrode G of the drive TFT DR at the high potential driving voltage Vdd during the first and second periods T1 and T2.

The second switch TFT SW2 includes a gate electrode G connected to the j-th gate line GLj, a drain electrode D connected to the data drive circuit 320 through the j-th data line DLj, and a source electrode S connected to the second node n2. The second switch TFT SW2 switches on and off a current path between the j-th data line DLj and the second node n2 in response to the scan pulse Sp. Thus the reference current Iref is sunk through the drive TFT DR and the second switch TFT SW2 during the first period T1. The second switch TFT SW2 raises a potential of the source electrode S of the drive TFT DR from the sensing voltage Vsen set by the reference current Iref to the data voltage Vdata during the second period T2.

The storage capacitor Cst includes a first electrode connected to the first node n1 and a second electrode connected to the second node n2. During the third period T3 during which the organic light emitting diode OLED emits light, the storage capacitor Cst keeps the voltage between the gate and source electrodes of the drive TFT DR set during the first and second periods T1 and T2 constant.

The detailed operation of the pixel 322 in the third exemplary embodiment is substantially the same as that of the pixel 222 in the second exemplary embodiment with the exception of the potential of the gate electrode G of the drive TFT DR is uniformly held at the high potential driving voltage Vdd during the first and second periods T1 and T2. Thus, a description thereof is not repeated.

As described above, while it is difficult to control the current data depending on each gray level in the OLED display, the driving current actually flowing in the organic light emitting diode is formed by setting a compensation voltage using the relatively high reference current and downscaling the set voltage according to the third exemplary embodiment of the invention.

Although not shown in the OLED display according to the third exemplary embodiment of the invention described above, in an alternative embodiment, the driving current actually flowing in the organic light emitting diode may be formed by setting a compensation voltage using a relatively low reference current and upscaling the set voltage, so as to reduce the output deviation and the load amount of the data drive circuits for applying a high reference current under a large area. In this case, the potential of the gate electrode of the drive element may be fixed at the reference voltage, and the potential of the source electrode of the drive element may be set at a compensation voltage and at the same time the set voltage may be lowered, thereby upscaling the driving current.

Fourth Exemplary Embodiment

As done in the first exemplary embodiment described above, an OLED display according to a fourth exemplary embodiment of the present invention fixes a potential of a source electrode of a drive element at a compensation voltage and reduces/increases a potential of a gate electrode of the drive element from a previously supplied reference voltage, thereby downscaling/upscaling a driving current. Unlike the first exemplary embodiment, however, the OLED display according to the fourth exemplary embodiment of the invention includes a dual drive element inside one pixel that alternately drives the dual drive element using two scan pulses that alternate at every predetermined time interval, so that the degradation of a threshold voltage of the drive element is reduced.

Figure 17:
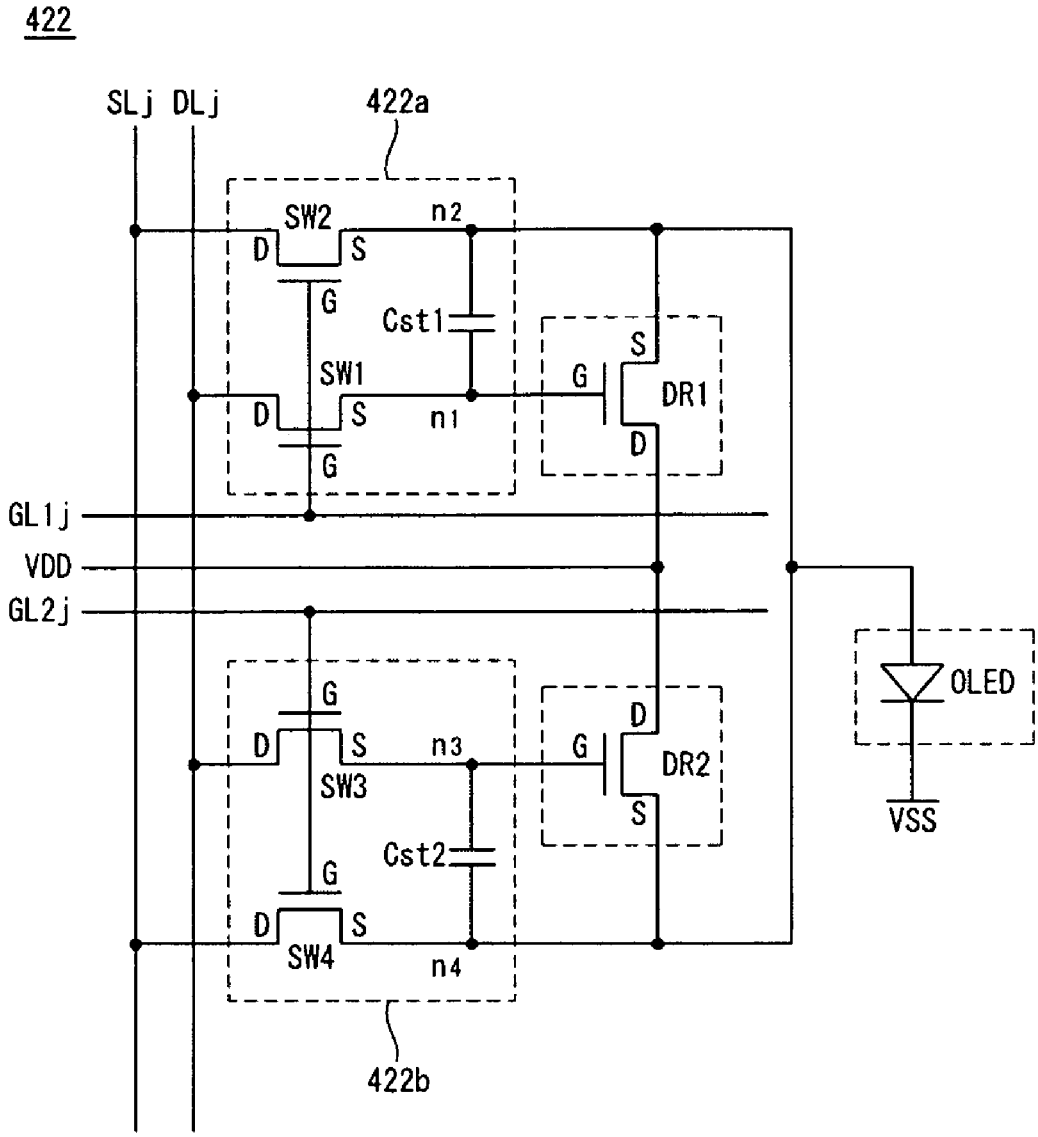
FIG. 17 is an equivalent circuit diagram of a pixel at a crossing of j-th signal lines according to a fourth exemplary embodiment of the invention.

FIG. 17 is an equivalent circuit diagram of an exemplary pixel at a crossing of j-th signal lines according to the fourth exemplary embodiment of the invention. As shown in FIG. 17, the pixel 422 according to the fourth exemplary embodiment of the invention includes an organic light emitting diode OLED at a crossing region of j-th signal lines GL1*j*, GL2*j*, DLj, and SLj, a first drive TFT DR1, a second drive TFT DR2, a first cell drive circuit 422*a*, and a second cell drive circuit 422*b*. In the OLED display according to the fourth exemplary embodiment, the first and second gate lines GL1*j* and GL2*j* are used in a pair to partition one pixel 422. As shown in FIG.

20, a first scan pulse Sp1 supplied to the pixel 422 through the first gate line GL1*j* and a second scan pulse Sp2 supplied to the pixel 422 through the second gate line GL2*j* are alternately generated every k frame periods, where k is an natural number equal to or larger than 1.

The first drive TFT DR1 and the second drive TFT DR2 are connected in parallel to the organic light emitting diode OLED and are alternately driven in response to the first and second scan pulses Sp1 and Sp2. The first drive TFT DR1 is connected to the first cell drive circuit 422*a*, and the second drive TFT DR2 is connected to the second cell drive circuit 422*b*.

The first cell drive circuit 422*a* includes a first storage capacitor Cst1, a first switch TFT SW1, and a second switch TFT SW2. The first storage capacitor Cst1 includes a first electrode connected to a gate electrode G of the first drive TFT DR1 through a first node n1, and a second electrode connected to a source electrode S of the first drive TFT DR1 through a second node n2. The first switch TFT SW1 switches on and off a current path between the j-th data line DLj and the first node n1 in response to the first scan pulse Sp1 received from the first gate line GL1*j*. The second switch TFT SW2 switches on and off a current path between the j-th sensing line SLj and the second node n2 in response to the first scan pulse Sp1.

The second cell drive circuit 422*b* includes a second storage capacitor Cst2, a third switch TFT SW3, and a fourth switch TFT SW4. The second storage capacitor Cst2 includes a first electrode connected to a gate electrode G of the second drive TFT DR2 through a third node n3, and a second electrode connected to a source electrode S of the second drive TFT DR2 through a fourth node n4. The third switch TFT SW3 switches on and off a current path between the j-th data line DLj and the third node n3 in response to the second scan pulse Sp2 received from the second gate line GL2*j*. The fourth switch TFT SW4 switches on and off a current path between the j-th sensing line SLj and the fourth node n4 in response to the second scan pulse Sp2.

Figure 21:
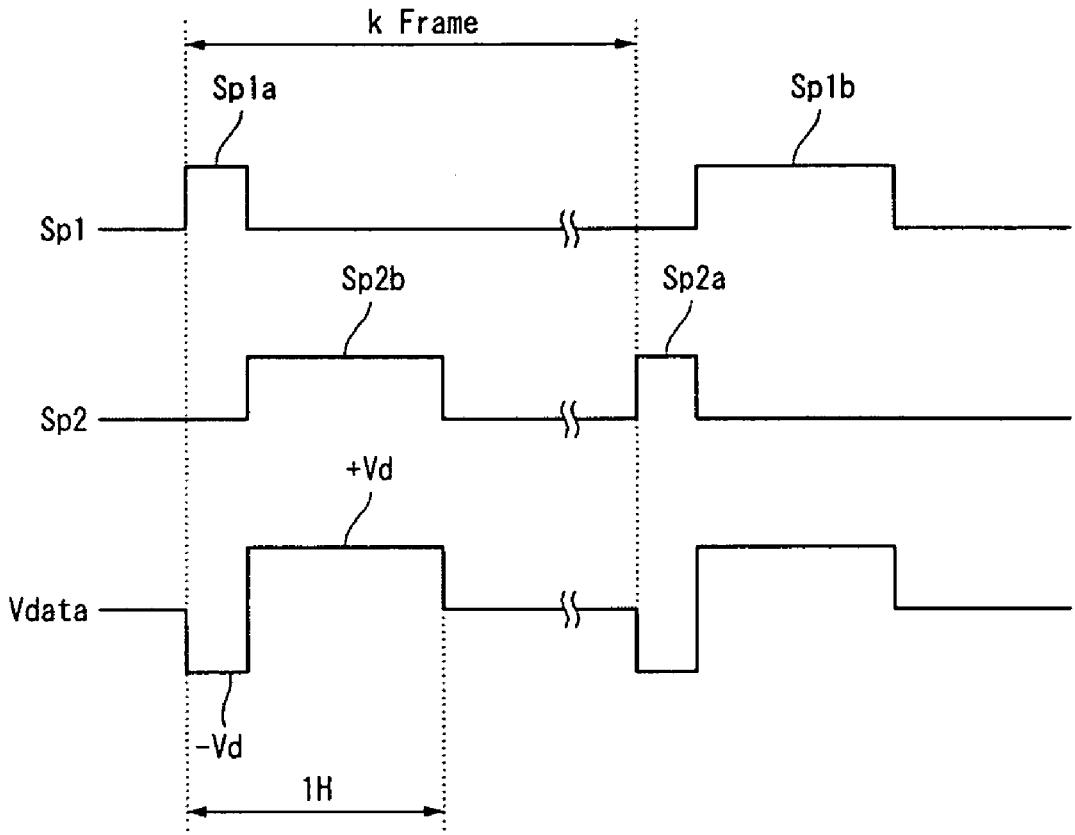
FIG. 21 is another exemplary timing diagram of a scan pulse according to the fourth to sixth exemplary embodiments of the invention.

The OLED display according to the fourth exemplary embodiment may be driven by a scan pulse shown in FIG. 21. As shown in FIG. 21, the first scan pulse Sp1 includes a 1-1 scan pulse Sp1*a* with a first width and a 1-2 scan pulse Sp1*b* with a second width larger than the first width. The second scan pulse Sp2 includes a 2-1 scan pulse Sp2*a* with a first width and a 2-2 can pulse Sp2*b* with a second width larger than the first width. The 1-1 scan pulse Sp1*a* and the 2-1 scan pulse Sp2*a* are synchronized with a negative data voltage −Vd supplied through the data lines and are alternately generated every k frame periods. The 1-2 scan pulse Sp1*b* and the 2-2 scan pulse Sp2*b* are synchronized with a positive data voltage +Vd supplied through the data lines and are alternately generated every k frame periods. Accordingly, the first drive TFT DR1 and the second drive TFT DR2 are alternately driven every k frame periods in response to the 1-2 scan pulse Sp1*b* and the 2-2 scan pulse Sp2*b* alternately generated every k frame periods, respectively.

The first drive TFT DR1 and the second drive TFT DR2 alternately receive a negative gate-bias stress every k frame periods in response to the 1-1 scan pulse Sp1*a* and the 2-1 scan pulse Sp2*a* alternately generated every k frame periods, respectively. In other words, during the k frame periods, the negative data voltage −Vd smaller than a threshold voltage of the first drive TFT DR1 is applied to the gate electrode G of the first drive TFT DR1, and thus the degradation of the threshold voltage of the first drive TFT DR1 is compensated for in a drive stop state. Further, during the k frame periods, the positive data voltage +Vd larger than a threshold voltage of the second drive TFT DR2 is applied to the gate electrode G of the second drive TFT DR2, and thus the second drive TFT DR2 is normally driven. On the other hand, during the next k frame periods, the positive data voltage +Vd larger than the threshold voltage of the first drive TFT DR1 is applied to the gate electrode G of the first drive TFT DR1, and thus the first drive TFT DR1 is normally driven. Further, during the next k frame periods, the negative data voltage −Vd smaller than the threshold voltage of the second drive TFT DR2 is applied to the gate electrode G of the second drive TFT DR2, and thus the degradation of the threshold voltage of the second drive TFT DR2 is compensated for in a drive stop state.

Fifth Exemplary Embodiment

As done in the second exemplary embodiment described above, an OLED display according to a fifth exemplary embodiment of the present invention fixes a potential of a gate electrode of a drive element at a reference voltage and sets a potential of a source electrode of the drive element at a compensation voltage and at the same time reduces/increases the set voltage, thereby downscaling/upscaling a driving current. Unlike the second exemplary embodiment, however, the OLED display according to the fifth exemplary embodiment of the invention includes a dual drive element inside one pixel that alternately drives the dual drive element using two scan pulses that alternate at every predetermined time interval, so that the degradation of a threshold voltage of the drive element is reduced.

Figure 18:
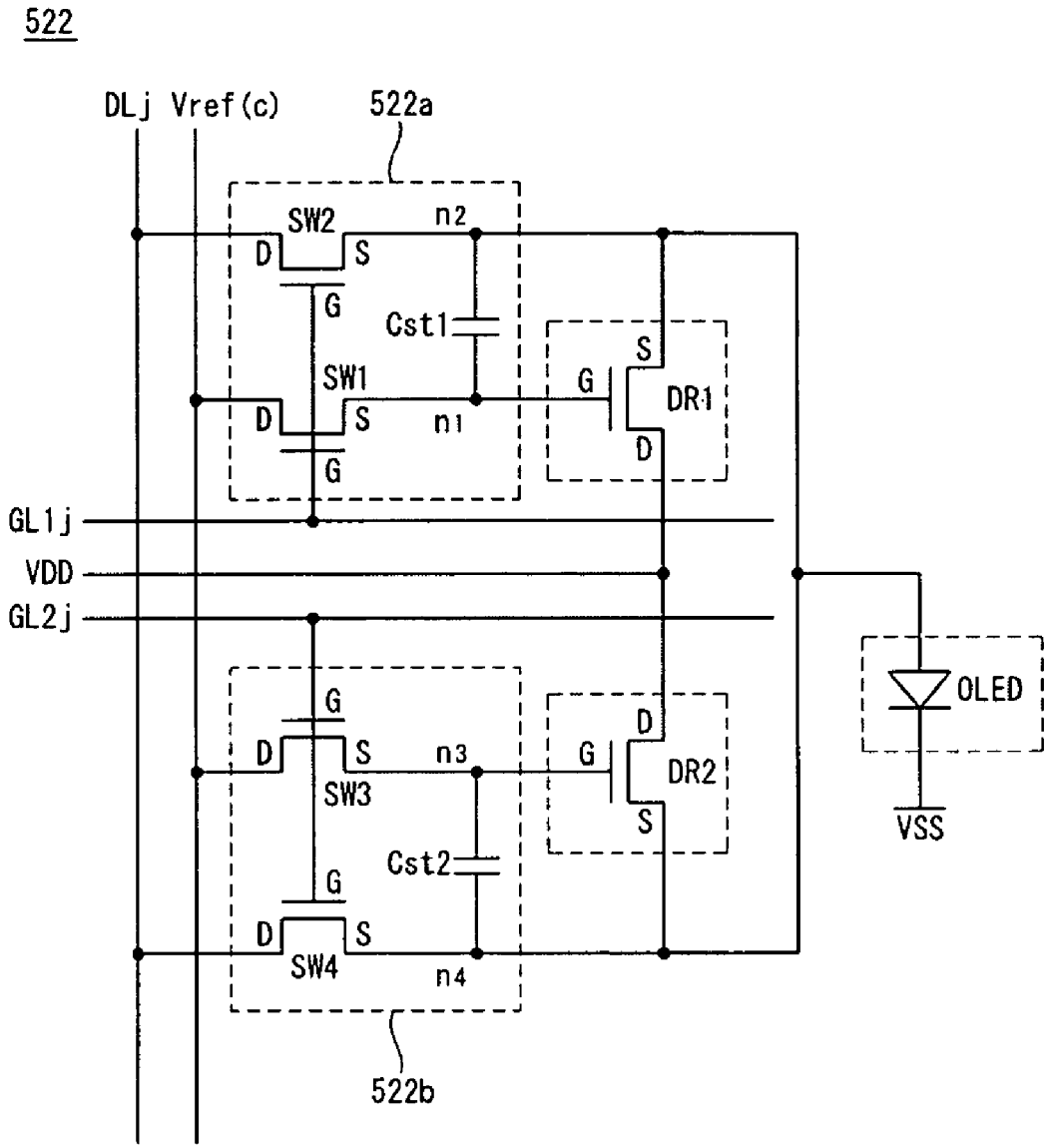
FIG. 18 is an equivalent circuit diagram of a pixel at a crossing of j-th signal lines according to a fifth exemplary embodiment of the invention.
Figure 20:
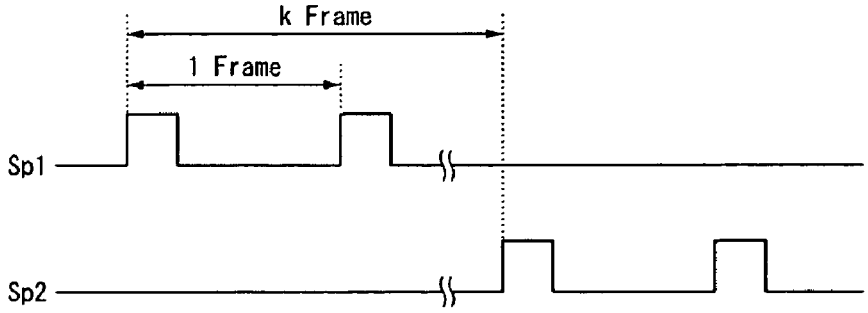
FIG. 20 is an exemplary timing diagram of a scan pulse according to the fourth to sixth exemplary embodiments of the invention.

FIG. 18 is an equivalent circuit diagram of an exemplary pixel at a crossing of j-th signal lines according to the fifth exemplary embodiment of the invention. As shown in FIG. 18, the pixel 522 according to the fifth exemplary embodiment of the invention includes an organic light emitting diode OLED at a crossing of j-th signal lines GL1*j*, GL2*j* and DLj, a first drive TFT DR1, a second drive TFT DR2, a first cell drive circuit 522*a*, and a second cell drive circuit 522*b*. In the OLED display according to the fifth exemplary embodiment, the first and second gate lines GL1*j* and GL2*j* are used in a pair to partition one pixel 522. As shown in FIG. 20, a first scan pulse Sp1 supplied to the pixel 522 through the first gate line GL1*j* and a second scan pulse Sp2 supplied to the pixel 522 through the second gate line GL2*j* are alternately generated every k frame periods, where k is an natural number equal to or larger than 1.

The first drive TFT DR1 and the second drive TFT DR2 are connected in parallel to the organic light emitting diode OLED and are alternately driven in response to the first and second scan pulses Sp1 and Sp2. The first drive TFT DR1 is connected to the first cell drive circuit 522*a*, and the second drive TFT DR2 is connected to the second cell drive circuit 522*b*.

The first cell drive circuit 522*a* includes a first storage capacitor Cst1, a first switch TFT SW1, and a second switch TFT SW2. The first storage capacitor Cst1 includes a first electrode connected to a gate electrode G of the first drive TFT DR1 through a first node n1, and a second electrode connected to a source electrode S of the first drive TFT DR1 through a second node n2. The first switch TFT SW1 switches on and off a current path between a reference supply line "c" and the first node n1 in response to the first scan pulse Sp1 received from the first gate line GL1*j*. The second switch TFT SW2 switches on and off a current path between the j-th data line DLj and the second node n2 in response to the first scan pulse Sp1.

The second cell drive circuit 522*b* includes a second storage capacitor Cst2, a third switch TFT SW3, and a fourth switch TFT SW4. The second storage capacitor Cst2 includes a first electrode connected to a gate electrode G of the second drive TFT DR2 through a third node n3, and a second electrode connected to a source electrode S of the second drive TFT DR2 through a fourth node n4. The third switch TFT SW3 switches on and off a current path between the reference supply line "c" and the third node n3 in response to the second scan pulse Sp2 received from the second gate line GL2*j*. The fourth switch TFT SW4 switches on and off a current path between the j-th data line DLj and the fourth node n4 in response to the second scan pulse Sp2.

The OLED display according to the fifth exemplary embodiment may be driven by a scan pulse shown in FIG. 21. As shown in FIG. 21, the first scan pulse Sp1 includes a 1-1 scan pulse Sp1*a* with a first width and a 1-2 scan pulse Sp1*b* with a second width larger than the first width. The second scan pulse Sp2 includes a 2-1 scan pulse Sp2*a* with a first width and a 2-2 scan pulse Sp2*b* with a second width larger than the first width. The 1-1 scan pulse Sp1*a* and the 2-1 scan pulse Sp2*a* are synchronized with a negative data voltage −Vd supplied through the data lines and are alternately generated every k frame periods. The 1-2 scan pulse Sp1*b* and the 2-2 scan pulse Sp2*b* are synchronized with a positive data voltage +Vd supplied through the data lines and are alternately generated every k frame periods. Accordingly, the first drive TFT DR1 and the second drive TFT DR2 are alternately driven every k frame periods in response to the 1-2 scan pulse Sp1*b* and the 2-2 scan pulse Sp2*b* alternately generated every k frame periods, respectively.

The first drive TFT DR1 and the second drive TFT DR2 alternately receive a negative gate-bias stress every k frame periods in response to the 1-1 scan pulse Sp1*a* and the 2-1 scan pulse Sp2*a* alternately generated every k frame periods, respectively. In other words, during the k frame periods, the negative data voltage −Vd smaller than a threshold voltage of the first drive TFT DR1 is applied to the gate electrode G of the first drive TFT DR1, and thus the degradation of the threshold voltage of the first drive TFT DR1 is compensated for in a drive stop state. Further, during the k frame periods, the positive data voltage +Vd larger than a threshold voltage of the second drive TFT DR2 is applied to the gate electrode G of the second drive TFT DR2, and thus the second drive TFT DR2 is normally driven. On the other hand, during the next k frame periods, the positive data voltage +Vd larger than the threshold voltage of the first drive TFT DR1 is applied to the gate electrode G of the first drive TFT DR1, and thus the first drive TFT DR1 is normally driven. Further, during the next k frame periods, the negative data voltage −Vd smaller than the threshold voltage of the second drive TFT DR2 is applied to the gate electrode G of the second drive TFT DR2, and thus the degradation of the threshold voltage of the second drive TFT DR2 is compensated for in a drive stop state.

Sixth Exemplary Embodiment

As done in the third exemplary embodiment described above, an OLED display according to a sixth exemplary embodiment of the invention fixes a potential of a gate electrode of a drive element at a high potential driving voltage and sets a potential of a source electrode of the drive element at a compensation voltage and at the same time reduces/increases the set voltage, thereby downscaling/upscaling a driving current. Unlike the third exemplary embodiment, however, the OLED display according to the sixth exemplary embodiment of the invention includes a dual drive element inside one pixel that alternately drives the dual drive element using two scan pulses that alternate at every predetermined time interval, so that the degradation of a threshold voltage of the drive element is reduced.

Figure 19:
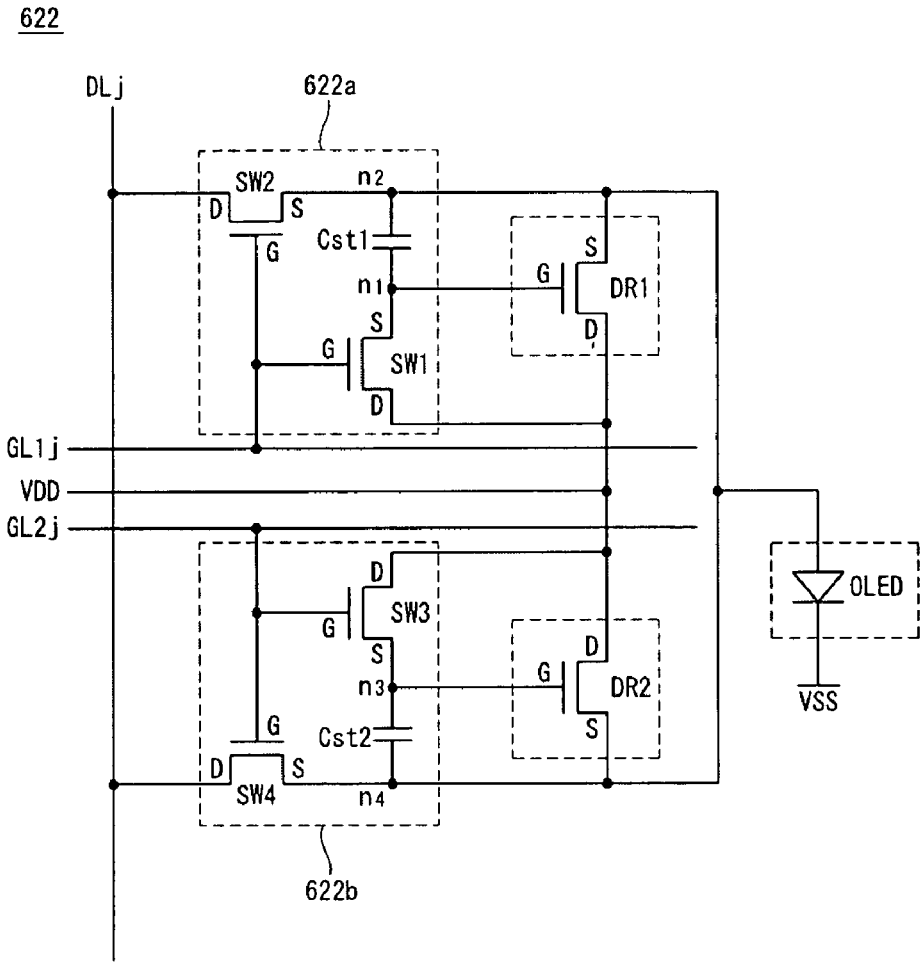
FIG. 19 is an equivalent circuit diagram of a pixel at a crossing of j-th signal lines according to a sixth exemplary embodiment of the invention.

FIG. 19 is an equivalent circuit diagram of an exemplary pixel at a crossing of j-th signal lines according to the sixth exemplary embodiment of the invention. As shown in FIG. 19, the pixel 622 according to the sixth exemplary embodiment of the invention includes an organic light emitting diode OLED at a crossing of j-th signal lines GL1*j*, GL2*j* and DLj, a first drive TFT DR1, a second drive TFT DR2, a first cell drive circuit 622*a*, and a second cell drive circuit 622*b*. In the OLED display according to the sixth exemplary embodiment, the first and second gate lines GL1*j* and GL2*j* are used in a pair to partition one pixel 622. As shown in FIG. 20, a first scan pulse Sp1 supplied to the pixel 622 through the first gate line GL1*j* and a second scan pulse Sp2 supplied to the pixel 622 through the second gate line GL2*j* are alternately generated every k frame periods, where k is an natural number equal to or larger than 1.

The first drive TFT DR1 and the second drive TFT DR2 are connected in parallel to the organic light emitting diode OLED and are alternately driven in response to the first and second scan pulses Sp1 and Sp2. The first drive TFT DR1 is connected to the first cell drive circuit 622*a*, and the second drive TFT DR2 is connected to the second cell drive circuit 622*b*.

The first cell drive circuit 622*a* includes a first storage capacitor Cst1, a first switch TFT SW1, and a second switch TFT SW2. The first storage capacitor Cst1 includes a first electrode connected to a gate electrode G of the first drive TFT DR1 through a first node n1, and a second electrode connected to a source electrode S of the first drive TFT DR1 through a second node n2. The first switch TFT SW1 switches on and off a current path between a high potential driving voltage source VDD and the first node n1 in response to the first scan pulse Sp1 received from the first gate line GL1*j*. The second switch TFT SW2 switches on and off a current path between the j-th data line DLj and the second node n2 in response to the first scan pulse Sp1.

The second cell drive circuit 622*b* includes a second storage capacitor Cst2, a third switch TFT SW3, and a fourth switch TFT SW4. The second storage capacitor Cst2 includes a first electrode connected to a gate electrode G of the second drive TFT DR2 through a third node n3, and a second electrode connected to a source electrode S of the second drive TFT DR2 through a fourth node n4. The third switch TFT SW3 switches on and off a current path between the high potential driving voltage source VDD and the third node n3 in response to the second scan pulse Sp2 received from the second gate line GL2*j*. The fourth switch TFT SW4 switches on and off a current path between the j-th data line DLj and the fourth node n4 in response to the second scan pulse Sp2.

The OLED display according to the sixth exemplary embodiment may be driven by a scan pulse shown in FIG. 21. As shown in FIG. 21, the first scan pulse Sp1 includes a 1-1 scan pulse Sp1*a* with a first width and a 1-2 scan pulse Sp1*b* with a second width larger than the first width. The second scan pulse Sp2 includes a 2-1 scan pulse Sp2*a* with a first width and a 2-2 scan pulse Sp2*b* with a second width larger than the first width. The 1-1 scan pulse Sp1*a* and the 2-1 scan pulse Sp2*a* are synchronized with a negative data voltage −Vd supplied through the data lines and are alternately generated every k frame periods. The 1-2 scan pulse Sp1*b* and the 2-2 scan pulse Sp2*b* are synchronized with a positive data voltage +Vd supplied through the data lines and are alternately generated every k frame periods. Accordingly, the first drive TFT DR1 and the second drive TFT DR2 are alternately driven every k frame periods in response to the 1-2 scan pulse Sp1*b* and the 2-2 scan pulse Sp2*b* alternately generated every k frame periods, respectively.

The first drive TFT DR1 and the second drive TFT DR2 alternately receive a negative gate-bias stress every k frame periods in response to the 1-1 scan pulse Sp1*a* and the 2-1 scan pulse Sp2*a* alternately generated every k frame periods, respectively. In other words, during the k frame periods, the negative data voltage −Vd smaller than a threshold voltage of the first drive TFT DR1 is applied to the gate electrode G of the first drive TFT DR1, and thus the degradation of the threshold voltage of the first drive TFT DR1 is compensated for in a drive stop state. Further, during the k frame periods, the positive data voltage +Vd larger than a threshold voltage of the second drive TFT DR2 is applied to the gate electrode G of the second drive TFT DR2, and thus the second drive TFT DR2 is normally driven. On the other hand, during the next k frame periods, the positive data voltage +Vd larger than the threshold voltage of the first drive TFT DR1 is applied to the gate electrode G of the first drive TFT DR1, and thus the first drive TFT DR1 is normally driven. Further, during the next k frame periods, the negative data voltage −Vd smaller than the threshold voltage of the second drive TFT DR2 is applied to the gate electrode G of the second drive TFT DR2, and thus the degradation of the threshold voltage of the second drive TFT DR2 is compensated for in a drive stop state.

As described above, the OLED display and the method of driving the same according to the exemplary embodiments of the present invention compensate for a difference between the threshold voltages of the drive TFTs, a difference between the mobilities of the drive TFTs, and a difference between the potentials of the Vss supply lines using a hybrid technique mixing current drive techniques with voltage drive technique, thereby preventing the degradation of the driving current and greatly improving the display quality.

Furthermore, the OLED display and the method of driving the same according to the exemplary embodiments of the present invention include a dual drive element inside each pixel that is alternately driven using two scan signals that alternate at every predetermined time interval, thereby minimizing the degradation of the threshold voltage of the drive element.

It will be apparent to those skilled in the art that various modifications and variations can be made in the OLED display of the present invention and the method of driving the same without departing from the spirit or scope of the invention. Thus, it is intended that the present invention cover the modifications and variations of this invention provided they come within the scope of the appended claims and their equivalents.

What is claimed is:

1. An organic light emitting diode display, comprising:

a data line;

a gate line that crosses the data line to receive a scan pulse;

a high potential driving voltage source configured to generate a high potential driving voltage;

a low potential driving voltage source configured to generate a low potential driving voltage;

a light emitting element configured to emit light due to a current flowing between the high potential driving voltage source and the low potential driving voltage source;

a drive element connected between the high potential driving voltage source and the light emitting element and configured to control a current flowing in the light emitting element, depending on a voltage between a gate electrode and a source electrode of the drive element; and a driving current stabilization circuit configured to apply a first voltage to the gate electrode of the drive element to turn on the drive element and to sink a reference current through the drive element to set a source voltage of the drive element at a sensing voltage and to modify the voltage between the gate and source electrodes of the drive element to scale a current to be applied to the light emitting element from the reference current, wherein the drive current stabilization circuit sets the source voltage of the drive element at a sensing voltage during a first period and then modifies the voltage between the gate and source electrodes of the drive element during a second period, such that the light emitting element is turned off during the first and second periods and turned on during a third period following the second period, wherein the first period is a first half period of the scan pulse maintained in a high logic voltage state, wherein the second period is a second half period of the scan pulse maintained in a high logic voltage state, and wherein the third period is a period during which the scan pulse is maintained in a low logic voltage state.

2. The organic light emitting diode display of claim 1, wherein the first voltage is a reference voltage.

3. The organic light emitting diode display of claim 1, wherein the first voltage is the high potential driving voltage.

4. The organic light emitting diode display of claim 1, wherein the drive current stabilization circuit changes a potential of the gate electrode of the drive element to reduce or increase the voltage between the gate and source electrodes of the drive element to scale the current to be applied to the light emitting element.

5. The organic light emitting diode display of claim 4, wherein:

a potential of the source electrode of the drive element is fixed at the sensing voltage; and the potential of the gate electrode of the drive element falls from the first voltage.

6. The organic light emitting diode display of claim 5, further comprising a sensing line positioned parallel to the data line.

7. The organic light emitting diode display of claim 6, wherein the driving current stabilization circuit comprises:

a cell drive circuit connected to the drive element and the light emitting element at a crossing of the data line, the sensing line, and the gate line; and data drive circuit connected to the cell drive circuit through the data line and the sensing line.

8. The organic light emitting diode display of claim 7, wherein the cell drive circuit comprises:

a storage capacitor including a first electrode connected to the gate electrode of the drive element through a first node and a second electrode connected to the source electrode of the drive element through a second node;

a first switch thin film transistor (TFT) configured to switch on and off a current path between the data line and the first node in response to the scan pulse; and a second switch TFT configured to switch on and off a current path between the sensing line and the second node in response to the scan pulse.

9. The organic light emitting diode display of claim 7, wherein the data drive circuit comprises:

a first data driver configured to supply the first voltage to the data line during a first period and to supply a data voltage that is reduced from the first voltage by a data change amount to the data line during a second period; and a second data driver configured to sink the reference current through the sensing line to set the sensing voltage during the first period and to keep the set sensing voltage constant during the second period.

10. The organic light emitting diode display of claim 9, wherein the first data driver comprises:

a data generation unit configured to alternately generate the first voltage and the data voltage, to extract the data change amount stored in memory based on a deviation amount of a mobility of the drive element depending on driving time, and to subtract or add the data change amount from the first voltage to generate the data voltage; and a first buffer configured to stabilize the first voltage and the data voltage generated by the data generation unit to output the stabilized first voltage and the stabilized data voltage to the data line.

11. The organic light emitting diode display of claim 9, wherein the second data driver comprises:

a reference current source configured to sink the reference current;

a second buffer configured to keep the sensing voltage constant;

a first switch configured to form a current path between the reference current source and an input terminal of the second buffer during the first period and to cut off the current path between the reference current source and the input terminal of the second buffer during the second period; and a second switch configured to form a current path between the sensing line and the reference current source during the first period and to form a current path between the sensing line and an output terminal of the second buffer during the second period.

12. The organic light emitting diode display of claim 6, wherein:

the gate line includes first and second gate lines forming a pair;

the drive element comprises first and second driving elements connected in parallel between the high potential driving voltage source and the light emitting element and are alternately driven; and the driving current stabilization circuit comprises:

a first cell driver connected to the first driving element and the light emitting element at a crossing of the data line, the sensing line, and the first gate line;

a second cell driver connected to the second driving element and the light emitting element at a crossing of the data line, the sensing line, and the second gate line; and a data drive circuit connected to the first and second cell drivers through the data line and the sensing line.

13. The organic light emitting diode display of claim 12, wherein:

the first cell driver comprises:

a first storage capacitor including a first electrode connected to a gate electrode of the first drive element through a first node and a second electrode connected to a source electrode of the first drive element through a second node;

a first switch TFT to switch on and off a current path between the data line and the first node in response to a first scan pulse received from the first gate line; and a second switch TFT to switch on and off a current path between the sensing line and the second node in response to the first scan pulse;

the second cell driver comprises:

a second storage capacitor including a first electrode connected to a gate electrode of the second drive element through a third node and a second electrode connected to a source electrode of the second drive element through a fourth node;

a third switch TFT to switch on and off a current path between the data line and the third node in response to a second scan pulse received from the second gate line, and a fourth switch TFT to switch on and off a current path between the sensing line and the fourth node in response to the second scan pulse; and the first and second scan pulses are alternately generated.

14. A method of driving a organic light emitting diode display including a data line, a gate line that crosses the data line to receive a scan pulse, a high potential driving voltage source to generate a high potential driving voltage, a low potential driving voltage source to generate a low potential driving voltage, a light emitting element to emit light due to a current flowing between the high potential driving voltage source and the low potential driving voltage source, and a drive element connected between the high potential driving voltage source and the light emitting element to control a current flowing in the light emitting element depending on a voltage between a gate electrode and a source electrode of the drive element, the method comprising:

applying a first voltage to the gate electrode of the drive element to turn on the drive element and sinking a reference current through the drive element to set a source voltage of the drive element at a sensing voltage during a first period;

modifying the voltage between the gate and source electrodes to scale a current to be applied to the light emitting element from the reference current during a second period; and driving the light emitting element using the scaled current during a third period, wherein the light emitting element is turned off during the first and second periods and turned on during the third period following the second period, wherein the first period is a first half period of the scan pulse maintained in a high logic voltage state, wherein the second period is a second half period of the scan pulse maintained in a high logic voltage state, and wherein the third period is a period during which the scan pulse is maintained in a low logic voltage state.

15. The method of claim 14, wherein the first voltage is a reference voltage.

16. The method of claim 14, wherein the first voltage is the high potential driving voltage.

17. The method of claim 14, wherein the modifying includes changing a potential of the gate electrode of the drive element to reduce or increase the voltage between the gate and source electrodes of the drive element to scale the current to be applied to the light emitting element.

18. The method of claim 17, wherein:

a potential of the source electrode of the drive element is fixed at the sensing voltage; and the potential of the gate electrode of the drive element falls from the first voltage.

* * * * *